US007448378B2

(12) United States Patent
Hirose

(10) Patent No.: US 7,448,378 B2
(45) Date of Patent: Nov. 11, 2008

(54) INFORMATION PROCESSING DEVICE FOR DIVER, CONTROL METHOD, CONTROL PROGRAM AND RECORDING MEDIUM THEREOF, DIVING EQUIPMENT, CONTROL METHOD OF DIVING EQUIPMENT

(75) Inventor: Takeshi Hirose, Shioziri (JP)

(73) Assignee: Seiko Epson Corporation, Tokyo (JP)

( * ) Notice: Subject to any disclaimer, the term of this patent is extended or adjusted under 35 U.S.C. 154(b) by 653 days.

(21) Appl. No.: 10/730,257

(22) Filed: Dec. 9, 2003

(65) Prior Publication Data

US 2005/0004711 A1 Jan. 6, 2005

(30) Foreign Application Priority Data

| | | |
|---|---|---|
| Dec. 11, 2002 | (JP) | 2002-359191 |
| Dec. 11, 2002 | (JP) | 2002-359192 |
| Dec. 19, 2002 | (JP) | 2002-368170 |
| Oct. 28, 2003 | (JP) | 2003-367213 |
| Oct. 28, 2003 | (JP) | 2003-367214 |
| Oct. 28, 2003 | (JP) | 2003-367215 |

(51) Int. Cl.
*B63C 11/02* (2006.01)
*A61M 16/00* (2006.01)

(52) U.S. Cl. ..... 128/201.27; 128/203.25; 128/203.27; 128/204.18; 128/204.22; 128/204.21; 128/204.26; 128/205.22

(58) Field of Classification Search ..... 128/200.24, 128/201.26, 201.27, 204.18, 204.22, 204.26, 128/205.22, 201.28; 405/185, 186
See application file for complete search history.

(56) References Cited

U.S. PATENT DOCUMENTS

| | | | | |
|---|---|---|---|---|
| 5,503,145 | A * | 4/1996 | Clough | 128/204.22 |
| 5,794,616 | A * | 8/1998 | Cochran et al. | 128/205.11 |
| 5,899,204 | A * | 5/1999 | Cochran | 128/205.23 |
| 5,926,779 | A * | 7/1999 | Garofalo | 702/138 |
| 6,618,059 | B1 * | 9/2003 | Furuta | 715/772 |

FOREIGN PATENT DOCUMENTS

| | | |
|---|---|---|
| JP | 7-31597 U | 6/1995 |
| JP | 11-020787 A | 1/1999 |

* cited by examiner

*Primary Examiner*—Justine R Yu
*Assistant Examiner*—Annette F Dixon
(74) *Attorney, Agent, or Firm*—Global IP Counselors, LLP

(57) ABSTRACT

An information processing device for a diver used for diving by using a plurality of mixed gases in which the mixture ratios of a plurality of diving gases are the same or different determines the switch timing of the mixed gas on the basis of a preset scheduled dive pattern and an actual dive pattern up to present. A notification is issued regarding the switch timing and information for specifying the mixed gas to which a switch is to be made based on this switch timing. When the diver selects one of the cylinders as the cylinder to which the switch is to be made and in which the mixture ratio of the diving gas is different, processing is carried out that prohibits switching to the selected cylinder when it is determined that the selected cylinder may create a danger of oxygen deficiency or oxygen poisoning.

17 Claims, 24 Drawing Sheets

| CYLINDER | $O_2$ | $N_2$ | He |
|---|---|---|---|
| 1A | 21% | 79% | 0% |
| 1B | 15% | 45% | 40% |
| 1C | 50% | 0% | 50% |
| 1D | 70% | 10% | 20% |

Fig. 3

| | $O_2$ | $N_2$ | He |
|---|---|---|---|
| 0 - 40 M | 21 – 50 % | 0 – 79 % | 0 – 92 % |
| 40 - 60 M | 16 – 40 % | 0 – 60 % | 10 – 92 % |
| 60 - 100 M | 8 – 20 % | 0 – 40 % | 20 – 92 % |
| DECOMPRESSION DIVING | 21 – 99 % | 0 – 50 % | 0 – 50 % |

| Setting Code | Parameter | Condition |
|---|---|---|
| 1 | Dive Time | 0 - 10 Minutes |
| 2 | | 11 - 20 Minutes |
| 3 | | 21 - 30 Minutes |
| 4 | | 31 - 40 Minutes |
| 5 | | 41 - 50 Minutes |
| 6 | | 51 - 60 Minutes |
| 7 | | 61 - 70 Minutes |
| 8 | | 71 - 80 Minutes |
| 9 | | 81 - 90 Minutes |
| 10 | | 91 - 100 Minutes |
| 11 | Body Oxygen Content | 1 - 2 |
| 12 | | 3 - 4 |
| 13 | | 5 - 6 |
| 14 | | 7 - 8 |
| 16 | Body Inert Gas Content | 1 - 2 |
| 17 | | 3 - 4 |
| 18 | | 5 - 6 |
| 19 | | 7 - 8 |
| 20 | | 9 |
| 21 | Allowed Dive Time | 200 - 151 Minutes |
| 22 | | 150 - 101 Minutes |
| 23 | | 100 - 51 Minutes |
| 24 | | 50 - 0 Minutes |
| 25 | Depth | 10 m - 20 m |
| 26 | | 20 m - 30 m |
| 27 | | 30 m - 40 m |
| 28 | | 40 m - 50 m |
| 29 | | 50 m - 60 m |
| 30 | | 60 m - 70 m |
| 31 | | 70 m - 80 m |
| 32 | | 80 m - 90 m |
| 33 | | 90 m - 100 m |

Fig. 19

| SWITCH TIMING SETTING |
| --- |
| CYLINDER 1A $O_2$: 21%, $N_2$: 79%, He: 0%<br>CYLINDER FOR INITIAL USE |
| CYLINDER 1B $O_2$: 15%, $N_2$: 45%, He: 40%<br>Switch At 1, 27, And 17 |
| CYLINDER 1C $O_2$: 50%, $N_2$: 0%, He: 50%<br>Switch At 3, 12, 20, And 29 |
| CYLINDER 1D $O_2$: 70%, $N_2$: 10%, He: 20%<br>Switch At 6, 24, And 25 |

Fig. 20

INFORMATION PROCESSING DEVICE FOR DIVER, CONTROL METHOD, CONTROL PROGRAM AND RECORDING MEDIUM THEREOF, DIVING EQUIPMENT, CONTROL METHOD OF DIVING EQUIPMENT

BACKGROUND OF THE INVENTION

1. Field of the Invention

The present invention relates to an information processing device for a diver, a control method, a control program, a recording medium thereof, diving equipment, and a method for controlling the diving equipment. In particular, the invention relates to an information processing device for a diver, a control method, a control program, a recording medium thereof, diving equipment, and a method for controlling the diving equipment that can be used in deep diving.

2. Background Information

It is conventionally known that nitrogen and other inhaled inert gases dissolved in the body as a result of diving form bubbles in the body and bring about decompression sickness. Also, in air diving, in which ordinary air is used as the breathing gas, the probability is high that so-called nitrogen poisoning will occur when the dive is made to a depth in excess of about 30 m, although the effect varies depending on the body mass or skill level.

Devices in which the information necessary to ensure diver safety, such as the current depth, the time needed to purge the excess inert gas accumulated in the body, or the safe ascent velocity, by means of a predetermined algorithm during diving, and the results are displayed on a liquid crystal display panel or other display are known as diver's information processing devices referred to as dive computers and designed to overcome the above-described drawbacks. Such a diver's information processing device is disclosed, for example, in Japanese Laid-Open Patent Publication No. 11-20787.

In addition, mixed gas diving, performed using a gas mixture of nitrogen and oxygen with an increased nitrogen concentration, is employed when a dive to a greater depth (deep diving) is involved.

With the aforementioned conventional mixed gas diving, however, the probability that nitrogen poisoning will occur is still high when the depth exceeds about 40 m. In addition, a switching error may lead to an oxygen deficiency in the case of a plurality of cylinders in which the diving gas is mixed in the same or different mixture ratios. Diving (deep diving) in which divers descend to depths in excess of 40 m are common in commercial diving or the like.

In view of the above, and based on the disclosure of the present invention, it is apparent to those skilled in the art that a need exists for an improved information processing device for a diver, control method, control program, recording medium thereof, diving equipment, and method for controlling the diving equipment. The present invention has been developed in response to such needs of the prior art and to other needs, which will become apparent to those skilled in the art from the disclosure given below.

SUMMARY OF THE INVENTION

It is an object of the present invention to provide an information processing device for a diver, a control method, a control program, a recording medium thereof, diving equipment, and a method for controlling the diving equipment that allow the incidence of oxygen deficiency, decompression sickness, nitrogen poisoning, or oxygen poisoning to be reduced during deep diving.

In order to achieve the above mentioned and other objects of the present invention, an information processing device for diver adapted to be used for diving with at least first and second cylinders respectively containing first and second mixed gases of a plurality of diving gases comprises a switch timing determination unit and a notification unit. The switch timing determination unit is configured to determine a switch timing between said first mixed gas to said second mixed gas based on a preset scheduled dive pattern and an actual dive pattern up to present. The notification unit is configured to provide information for specifying the second mixed gas and the switch timing based on the switch timing.

The objects, features, advantages, and other characteristics of the present invention will become apparent to those skilled in the art from the description of the present invention given below. Together with the accompanying drawings, the description of the invention that follows is designed to disclose the preferred embodiments of the invention.

BRIEF DESCRIPTION OF THE DRAWINGS

Referring now to the attached drawings which form a part of this original disclosure:

FIG. 3 is a diagram illustrating an example of mixture ratios for the diving gas contained in the cylinders of the diving equipment relating to the first embodiment of the invention;

FIG. 19 is a diagram illustrating a table for setting the cylinder switch conditions in the first embodiment of the invention;

FIG. 20 is a diagram illustrating an example in which cylinder switch timing is set in the first embodiment of the invention;

DETAILED DESCRIPTION OF THE PREFERRED EMBODIMENTS

Embodiments of the invention will now be described with reference to the drawings. As will be apparent from the disclosure of the present invention to those skilled in the art, the description of the invention embodiments should not be construed as limiting the scope of the present invention, which is defined by the claims described below or by equivalent claims thereof.

First, the information processing device for a diver will be described in accordance with a first embodiment of the invention with reference to FIG. 1. With the information processing device for a diver relating to the first embodiment of the invention, the switch timing of mixed gas is determined based on a preset scheduled dive pattern and an actual dive pattern up to present, and a notification is sent out regarding information for specifying the pre-switch gas mixture on the basis of the switch timing, and regarding the switch timing itself. It is therefore possible to prevent oxygen deficiency, decompression sickness, nitrogen poisoning, or oxygen poisoning from occurring during deep diving, or to avoid or reduce the occurrence of these during a deep dive.

Figure 1:
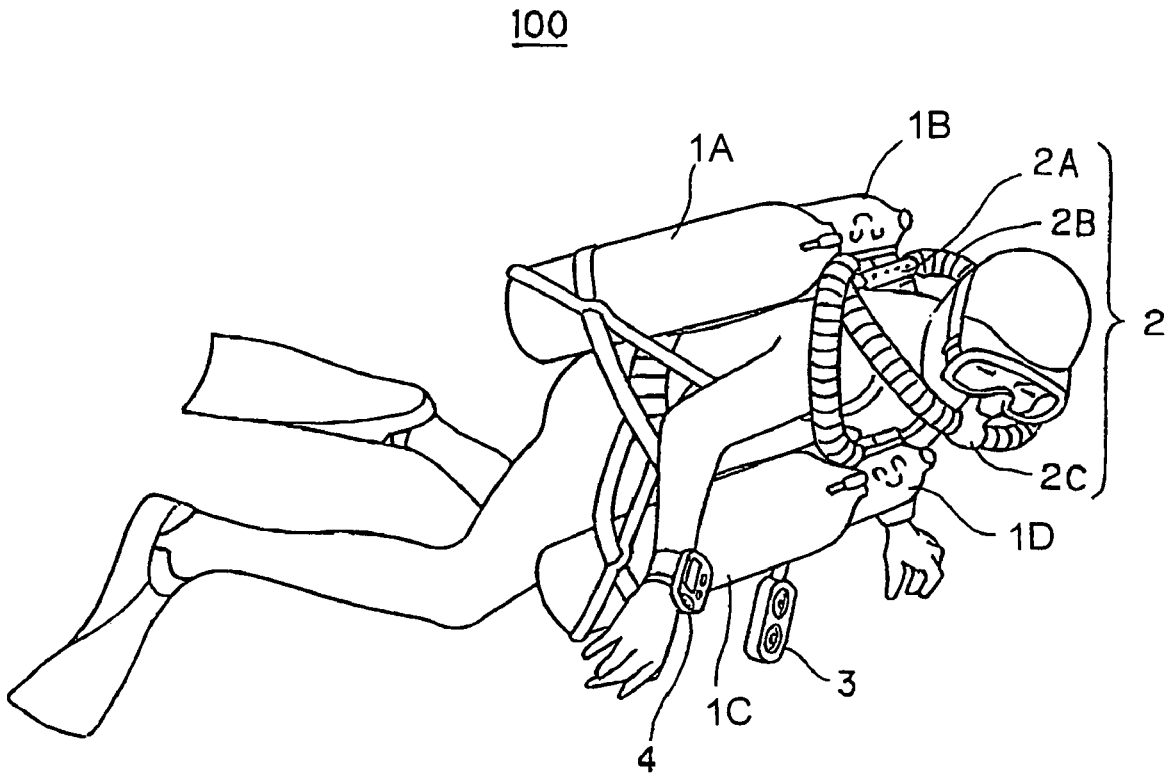
FIG. 1 is a diagram illustrating the use of the diving equipment relating to a first embodiment of the invention.
Figure 2:
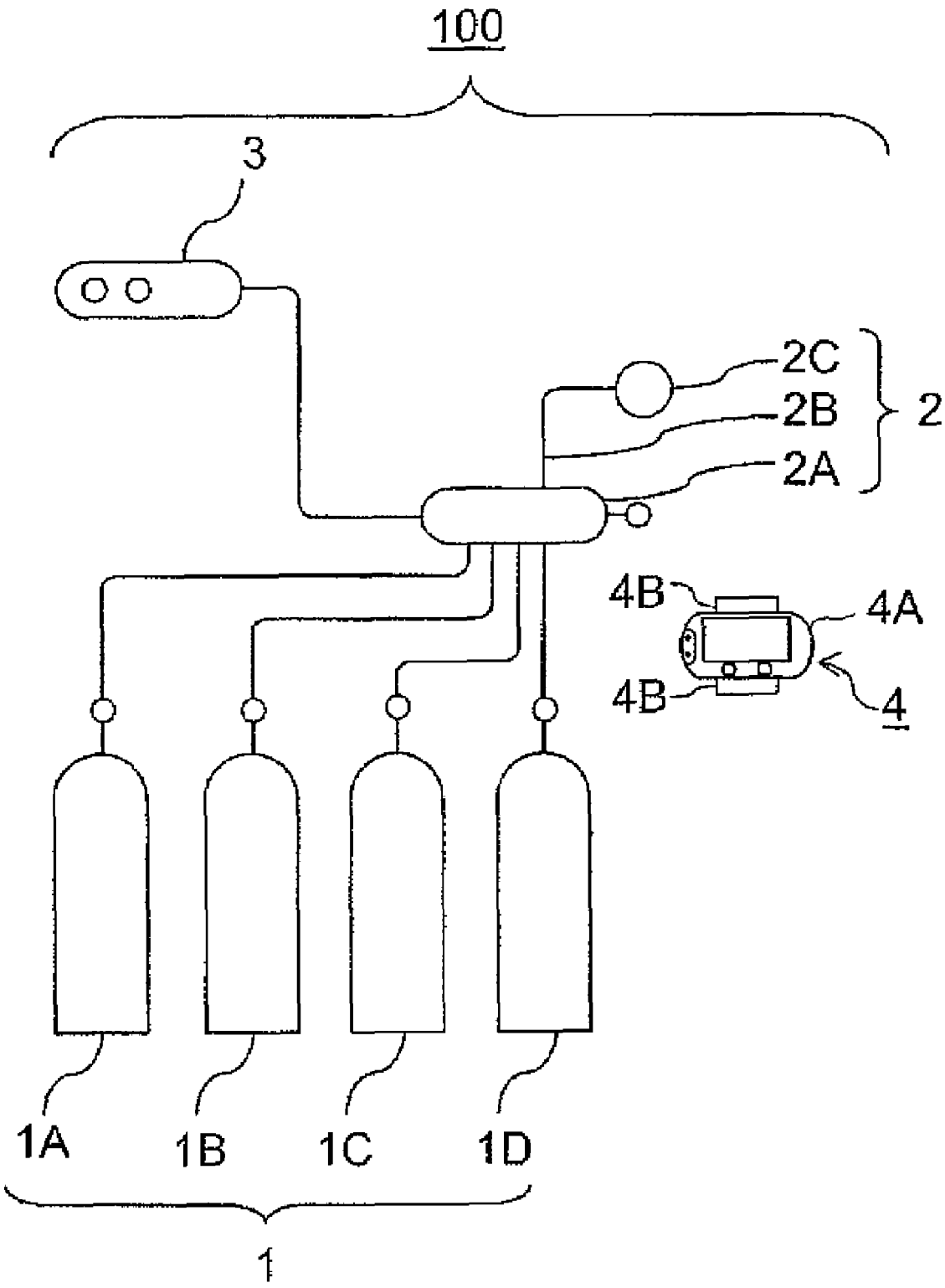
FIG. 2 is a diagram illustrating the layout of the diving equipment relating to the first embodiment of the invention.

FIG. 1 is a diagram illustrating the use of the diving apparatus (diving equipment) relating to a first embodiment of the invention. FIG. 2 is a diagram illustrating the layout of the diving apparatus relating to the embodiment. In broad terms, the diving apparatus (diving equipment) 100 has a cylinder unit 1 with a plurality of cylinders 1A to 1D, a switching valve (switching device)/regulator 2, a depth/residual pressure gage 3, and an information processing device for a diver/dive computer 4.

In the first embodiment, it is preferable that each of the cylinders 1A to 1D constituting the cylinder unit 1 be filled with a mixed gas obtained by mixing two or three types of diving gas and that each cylinder have a different mixture ratio. A plurality of cylinders with the same mixture ratios, and at least one more cylinder with a different mixture ratio may also be included as needed. In this case, any of the cylinders 1A to 1D may constitute the first/second cylinder, and any of the mixed gases contained in the cylinders 1A to 1D that correspond to the first/second cylinder may constitute the first/second mixed gas.

FIG. 3 is a diagram illustrating an example of mixture ratios for the diving gas. The description that follows will be given with reference to a case in which three types of gases, oxygen ($O_2$), nitrogen ($N_2$), and helium (He), are used for the diving gas.

Cylinder 1A has a mixture ratio $FO_2$ of 21% for oxygen $O_2$, a mixture ratio $FN_2$ of 79% for nitrogen $N_2$, and a mixture ratio FHe of 0% for helium He, which are the same mixture ratios as those for so-called ordinary air. A mixed gas with these mixture ratios can be used up to a depth of about 30 m in a submerged state.

Cylinder 1B has a mixture ratio $FO_2$ of 15% for oxygen $O_2$, a mixture ratio $FN_2$ of 45% for nitrogen $N_2$, and a mixture ratio FHe of 40% for helium He, which are used in a deep-dive region with a depth of 30 m or greater in a submerged state and during ascent. A mixed gas with these mixture ratios is primarily used in order to prevent oxygen poisoning.

Cylinder 1C has a mixture ratio $FO_2$ of 50% for oxygen $O_2$, a mixture ratio $FN_2$ of 0% for nitrogen $N_2$, and a mixture ratio FHe of 50% for helium He, which are used in the depth region that extends from a relatively great depth to a relatively low depth of about 10 m during ascent. A mixed gas with these mixture ratios is primarily used in order to prevent nitrogen poisoning.

Cylinder 1D has a mixture ratio $FO_2$ of 70% for oxygen $O_2$, a mixture ratio $FN_2$ of 10% for nitrogen $N_2$, and a mixture ratio FHe of 20% for helium He, which are used in decompression diving. Specifically, a mixed gas with these mixture ratios is primarily used in order to prevent decompression sickness.

The switching valve (switching device)/regulator 2 has a first stage 2A for switching the mixed gas fed from the cylinders 1A to 1D and setting the pressure of the mixed gas to a specific level, and a second stage 2C connected to the first stage 2A by a regulator hose 2B.

The depth/residual pressure gage 3 measures the depth during diving and the residual pressure (remaining amount) of the currently used cylinder from among the cylinders 1A to 1D, and displays the results.

Figure 4:
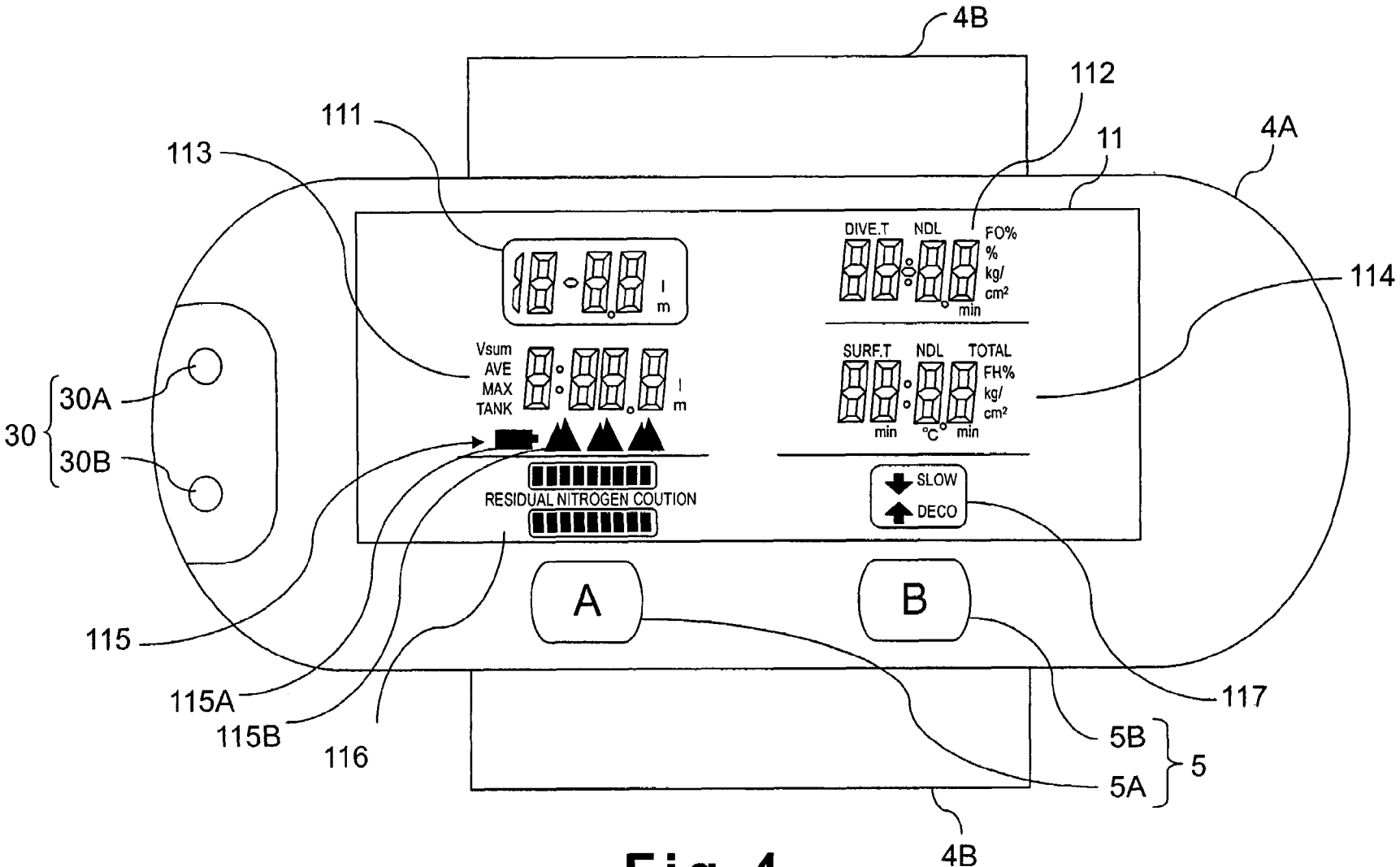
FIG. 4 is an external front view of the dive computer relating to the first embodiment of the invention.
Figure 5:
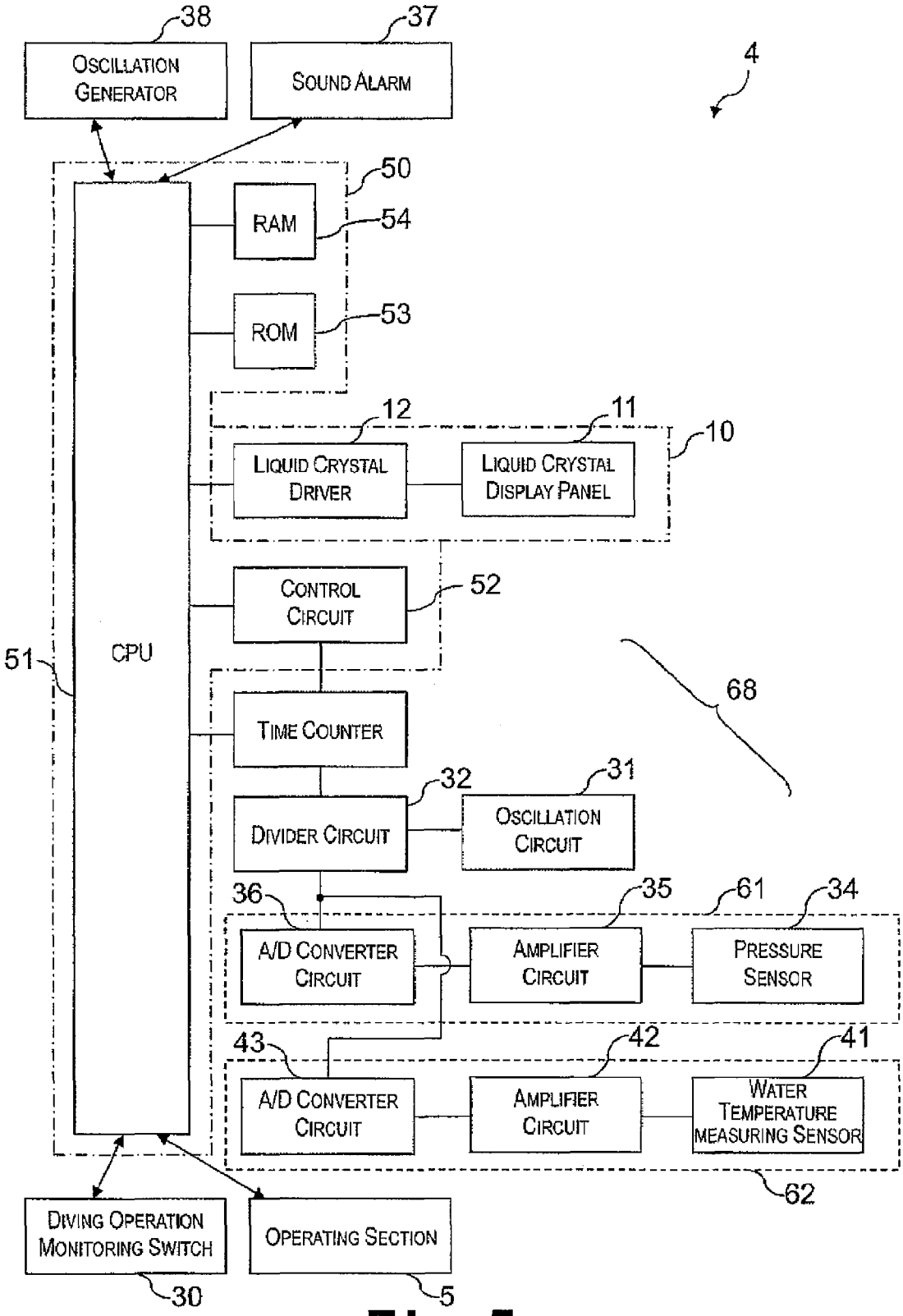
FIG. 5 is a schematic block diagram of the dive computer relating to the first embodiment of the invention.

FIG. 4 is an external front view of dive computer 4. Also, FIG. 5 is a schematic block diagram of dive computer 4. In basic terms, the dive computer 4 preferably has the following functions.

(1) To calculate and display the dive time and the diver depth during diving.

(2) To measure the amount of inert gas accumulated in the body during diving, and to display, based on the measurement results, the time or the like until the nitrogen accumulated in the body can be purged once the diver is on the surface following diving.

(3) To designate the switching of the switching valve/regulator 2 on the basis of a preset scheduled dive pattern and an actual dive pattern up to present, and to designate the subsequent dive pattern to be followed in order to prevent decompression sickness or the like.

The structure of the dive computer 4 will now be described with reference to FIGS. 4 and 5. As shown in FIG. 4, a wristband 4B is connected in the vertical direction in the drawing to a substantially elliptic device main body 4A, allowing the dive computer 4 to be mounted and worn on a user's hand with the aid of the wristband 4B in the same way as a wristwatch.

The device main body 4A is secured by screw fastening or another method while the upper and lower cases are kept in a completely airtight state, and contains various electronic parts (not shown). A display unit 10 with a liquid crystal display panel 11 (see FIG. 5) is disposed on the pictured front face of the device main body 4A.

An operating section 5 for selecting/switching the operating modes in the dive computer 4 is further formed on the pictured bottom of the device main body 4A, and the operating section 5 has two switches 5A and 5B shaped as pushbuttons. A diving operation monitoring switch 30 featuring a conduction sensor used for determining whether a dive has started is provided to the device main body 4A on the left-hand side of FIG. 4. The diving operation monitoring switch 30 has electrodes 30A and 30B disposed on the pictured front face of the device main body 4A, and it is determined that immersion in water has started when the resistance between the electrodes 30A and 30B is reduced as a result of a conductive state being established between the electrodes 30A and 30B by seawater or the like. However, the diving operation monitoring switch 30 is used solely to detect immersion in water and to cause the operating mode of the dive computer 4 to switch to the diving mode, not to detect that an actual dive (descent in water) has started. A specific reason is that there may be cases in which the user's hand with the dive computer 4 is merely immersed in seawater, and it is undesirable under such conditions to conclude that a dive has started. For this reason, it is assumed in the case of the dive computer 4 that a dive has started in the event that the water pressure (depth) registered by a pressure sensor inside the device main body 4A has reached or exceeded a certain level; specifically, the water pressure has reached or exceeded an equivalent of 1.5 m in terms of depth, and it is assumed that the dive has ended in the event that the water pressure is less than 1.5 m in terms of depth.

In basic terms, the dive computer 4 is preferably composed of a control unit 50, display unit 10, pressure gauge 61, water thermometer 62, and timer 68, as shown in FIG. 5. The control unit 50 of the dive computer preferably has a CPU 51 that is designed to control the entire device and is connected to the switches 5A and 5B of the operating section 5, the diving operation monitoring switch 30, a sound alarm 37, and an oscillation generator 38; a control circuit 52 that is designed to control a liquid crystal driver 12 in order to form a display that corresponds to each operating mode on the liquid crystal display panel 11 under control from CPU 51, or is designed to perform processing in each of the operating modes in the time counter 33 described below; ROM 53 for storing control programs and control data; and RAM 54 for temporarily storing each type of data.

In addition, the pressure gauge 61 is needed to measure and display depth (water pressure) in the dive computer 4 and to measure the amount of inert gas accumulated in the user's body on the basis of depth and dive time, and is therefore used to measure air pressure and water pressure. The pressure gauge 61 comprises a pressure sensor 34 consisting of a semiconductor pressure sensor, and also comprises an amplifier circuit 35 for amplifying the output signal of the pressure sensor 34 for amplifying the output signal of the pressure sensor 34, and an A/D converter circuit 36 for subjecting the output signal of the amplifier circuit 35 to an analog/digital conversion and outputting the result to the control unit 50.

The water thermometer 62 is composed of a water temperature measuring sensor 41, and an A/D converter circuit 43 for subjecting the output signal of the amplifier circuit 42 to an analog/digital conversion and outputting the result to the control unit 50; and is used to measure the water temperature.

The timer 68 is composed of an oscillation circuit 31 for outputting clock pulses of a specific frequency in order to keep time in the regular manner or to monitor the dive time in the dive computer 4; a divider circuit 32 for dividing the clock signals from the oscillation circuit 31; and a time counter 33 for processing time in one-second increments on the basis of the signal that is output by the divider circuit 32.

The structure of the display unit 10 will now be described in detail with reference to FIG. 4. The display surface of the liquid crystal display panel 11 constituting the display unit 10 has seven display areas. The present embodiment is described with reference to an example in which the display surface of the liquid crystal display panel 11 is shaped as a rectangle, but the rectangular shape is non-limiting, and a circular, elliptic, track-shaped, nonrectangular polygonal, or any other shape may also be used.

The first display area 111, which constitutes part of the display surface of the liquid crystal display panel 11 and is disposed on the upper left-hand side of FIG. 4, is configured larger than the other display areas and is designed to respectively display the current depth, the current month and day, the depth rank, and the diving month and day (log number) in the diving mode, surface mode (time display mode), planning mode, and log mode described below.

The second display area 112 is disposed to the right of the first display area 111 in FIG. 4 and is designed to display the dive time and oxygen saturation, current time, the time during which diving without decompression is possible, and the dive start time (dive time) in the diving mode, surface mode (time display mode), planning mode, and log mode, respectively.

The third display area 113 is disposed underneath the first display area 111 in FIG. 4 and is designed to display the maximum depth, the time to purge inert gas from the body, the safety level, and the maximum depth (mean depth) in the diving mode, surface mode (time display mode), planning mode, and log mode, respectively.

The fourth display area 114 is disposed to the right of the third display area 113 in FIG. 4 and is designed to display the time during which diving without decompression is possible, the surface interval, the temperature, and the dive end time (water temperature at maximum depth) in the diving mode, surface mode (time display mode), planning mode, and log mode, respectively.

The fifth display area 115 is disposed underneath the third display area 113 in FIG. 4 and is provided with a power supply capacity cutoff warning display unit 115A for displaying the power supply capacity cutoff, and an elevation rank display unit 115B for displaying the elevation rank belonging to the current elevation of the user.

The sixth display area 116 is disposed on the lower left-hand side of FIG. 4 and is designed to display the amount of inert gas in the body and the body oxygen content as corresponding bar graphs (a maximum of nine lights).

The seventh display area 117 is disposed to the right of the sixth display area 116 and is composed of an area for indicating whether nitrogen gas (inert gas) tends to be absorbed or purged (shown as vertical arrows in FIG. 4) when a decompression diving state has been established in the diving mode; an area that displays "SLOW" to suggest slowing down as a warning about an ascent velocity violation when the acceptable ascent velocity is exceeded; and an area that displays "DECO" to warn that a decompression stop must be made during a dive.

Described below is the mode adopted for using diving equipment featuring the dive computer 4 or the information processing device for a diver relating to the first embodiment of the invention.

Cylinders for which the mixture ratio of the diving gas has been changed in accordance with the depth must be switched during deep diving, and several cylinders (four cylinders 1A to 1D are used in the present embodiment) are carried for the dive. In order to ensure safe diving, the user must understand the set-up by simulating in advance which cylinder to use of the plurality of cylinders 1A to 1D and with what timing.

As described above, three types of gases, oxygen ($O_2$), nitrogen ($N_2$), and helium (He), are used for the mixed gas referred to in the present embodiment. Helium (He) is an odorless, nontoxic, non-explosive, inert gas.

The gas mixture ratio of the gas cylinders 1A to 1D must be set when a dive is made using a mixed gas, and because an extended dive is made in the case of deep diving, a plurality of gas cylinders 1A to 1D that have different mixture ratios of diving gas, in other words, that correspond to a plurality of types of mixed gas, must be prepared in accordance with the diving pattern. The mixture ratios of the diving gas in all of the gas cylinders 1A to 1D do not necessarily need to be different from each other, and there may be cases in which more than one of the gas cylinders 1D to 1D (two of four, for example) are filled with the same mixed gas.

As a result, a simulation must be carried out, and the gas mixture ratio to be used must be selected in advance from the diving pattern when the dive is made.

The simulation is described in detail below. A personal computer provided separately from the dive computer 4 or another simulator device is used to perform the actual simulation. First, the user who performs the simulation inputs the dive time and the depth value corresponding to the dive time to the simulator device. More specifically, the user inputs the dive (ascent) start depth at which the dive or ascent velocity corresponds to a substantially fixed range, the dive (ascent) target depth, and the time required to move between the target depth and the start depth.

The user further inputs the mixture ratio of oxygen, nitrogen, and helium for each of a plurality of cylinders, which are the four cylinders 1A to 1D in the present embodiment. In the case of an unrecognized mixture ratio setting, the user receives a notification on the basis of a preset database, and is encouraged to reenter the data.

When valid data is input, the simulator device executes the simulation, and the quantity of inert gas that is purged from or accumulated in the body in accordance with the dive time, the quantity of oxygen, oxygen partial pressure, and time during which diving without decompression is possible are computed from the depth value and the mixture ratio of the diving gas in the same manner as in actual diving.

The calculation of the oxygen partial pressure $PO_2$ will be described first. The oxygen partial pressure $PO_2$ is represented by the following expression, where Pw is the current water pressure, Pa is the atmospheric pressure, and $FO_2$ is the oxygen mixture ratio in the inhaled gas.

$$PO_2=(Pw+Pa)\times FO_2$$

When the current depth is 16 m, for example, the corresponding current water pressure Pw is 1.6 bars. When the atmospheric pressure Pa at this time is set to about 1 bar, and the oxygen mixture ratio $FO_2$ is 36%, the following expression can be written.

$$PO_2=(1.6+1)\times 0.36\approx 0.9 \text{ bar}$$

To prevent oxygen poisoning (oxygen intoxication), the maximum allowed oxygen partial pressure $PO_2$max is set to 1.6 bars in the dive computer 4 of the present embodiment. Therefore, divers that dive in accordance with the result of the simulation are diving properly if the oxygen partial pressure $PO_2$ is equal to or less than the maximum allowed oxygen partial pressure $PO_2$max, and divers can protect themselves from oxygen poisoning (oxygen intoxication). To prevent oxygen deficiency, the minimum allowed oxygen partial pressure $PO_2$min is set to 0.16 bar in the dive computer 4 of the present embodiment.

As described above, the maximum allowed oxygen partial pressure $PO_2$max is set to 1.6 bars, and the minimum allowed oxygen partial pressure $PO_2$min is set to 0.16 bar in the dive computer of the present embodiment; and the settings can be set on the safe side by way of software with a control program so that, for example, a warning is given at a maximum allowed oxygen partial pressure $PO_2$max of 1.3 to 1.4 bars, or the gas cylinders are prevented from being switched, in order to ensure safer diving, or to cause the diver, who is the user, to recognize danger in advance. In a similar manner, it is also possible to change the settings to the safe side for the minimum allowed oxygen partial pressure $PO_2$ min.

Figures 6, 7:
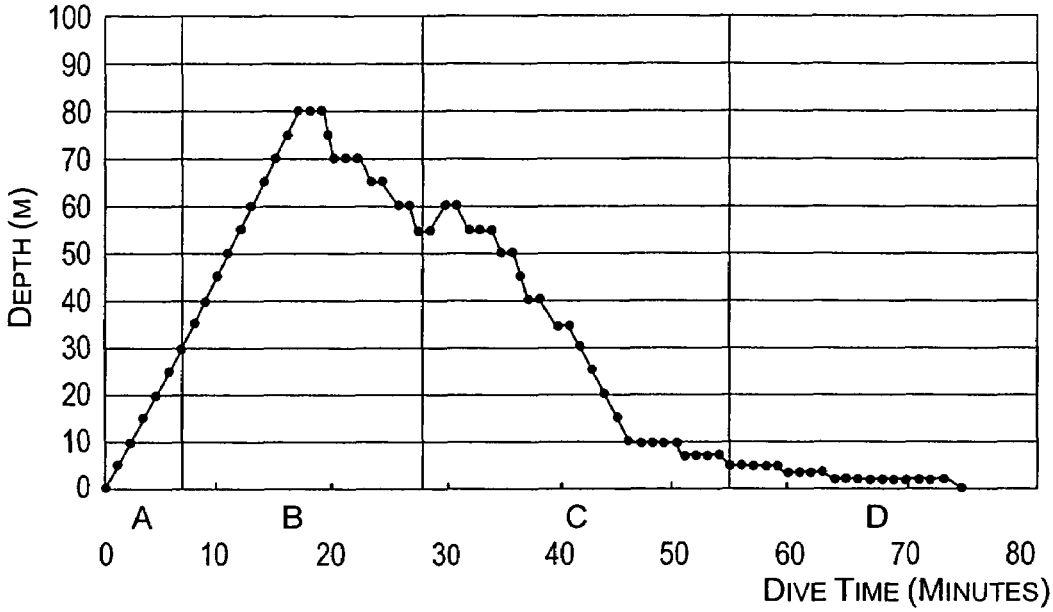
FIG. 6 is a diagram illustrating a dive pattern.
FIG. 7 is a diagram illustrating the approximate gas mixture ratios for each depth.

FIG. 6 is a diagram illustrating a dive pattern. In the dive pattern shown in FIG. 6, for example, the dive should be carried out with the mixture ratio set to the same mixture ratio as atmospheric gas (mainly oxygen and nitrogen) because the depth is still shallow in the A region of the dive pattern during the dive. In other words, the cylinder 1A is set to a mixture ratio $FO_2$ of 21% for oxygen, a mixture ratio $FN_2$ of 79% for nitrogen, and a mixture ratio FHe of 0% for helium in the A region of the dive pattern, as shown in FIG. 3.

When the diver desires to descend to a greater depth, the descent is carried out during the initial portion (preferably at the beginning of the dive) of the dive when nitrogen and oxygen have not yet accumulated in the body. The oxygen mixture ratio $FO_2$ and the nitrogen mixture ratio $FN_2$, which pose danger for the human body, are kept low, and a deep descent is made. The cylinder 1B is set to a mixture ratio $FO_2$ of 15% for oxygen, a mixture ratio $FN_2$ of 45% for nitrogen, and a mixture ratio FHe of 40% for helium, as shown in FIG. 3, in the B region of the dive pattern.

The ascent is made gradually because decompression sickness is easily brought about with deep descents of 100 m. At this time, the setting of the gas mixture ratio is brought to a low mixture ratio for nitrogen, and the danger of oxygen poisoning is recognized, in the region that extends to shallower depths. More specifically, the cylinder 1C is set to a mixture ratio $FO_2$ of 50% for oxygen, a mixture ratio $FN_2$ of 0% for nitrogen, and a mixture ratio FHe of 50% for helium, as shown in FIG. 3, in the C region of the dive pattern.

The ratio of inert gas is lowered and the oxygen mixture ratio is increased because the diver is at a shallow depth in a state of decompression diving in the D region of the dive pattern. More specifically, the cylinder 1D is set to a mixture ratio $FO_2$ of 70% for oxygen, a mixture ratio $FN_2$ of 10% for nitrogen, and a mixture ratio [FHe] of 20% for helium, as shown in FIG. 3.

FIG. 7 is a diagram illustrating the approximate gas mixture ratios for each depth. These ratios, as shown in FIG. 7, are merely approximations and must be changed in accordance with the application because the accumulation condition of gases in the body and the dive time in each situation are different during an actual dive.

The dive computer 4 related to the present embodiment sets a priority level (priority level from the viewpoint of life support and safety) in advance, stores the data, and prevents the setting for the diving gas that has a high priority level from being affected by the setting for the diving gas that has a low priority level. Therefore, CPU 51 or ROM 53 comprises a priority level storage unit. Moreover, CPU 51 comprises a unit for correcting the input values of low priority levels. More specifically, when the three types of diving gas of oxygen, nitrogen, and helium are used as in the present embodiment, the priority level is preferably set from the highest level, that is, oxygen, helium, and nitrogen. In the following description, setting is therefore conducted in the order of oxygen (manual setting)→helium (manual setting)→nitrogen (automatic setting).

The precautions that need to be taken for the common settings are described below. The oxygen mixture ratio is set low for deep diving in order to prevent oxygen poisoning. Inert gas accumulates inside the body, and the diver gradually ascends to a shallow depth if decompression diving conditions are established. Because inert gas is purged as the diver ascends, the proportion of oxygen is increased while oxygen poisoning and decompression sickness are taken into consideration, and in the case that an instruction to decompress has been given in the final portion of the dive at a depth of several meters, the inert gas inside the body is purged by decompression diving with the setting at near pure oxygen. As a result, the decompression time can be shortened, and it is possible to rise to the surface of the water at a stage during which a switch is made to non-decompression diving.

Preparation for carrying out simulated diving is subsequently described. In advance of diving, the diver prepares cylinders 1A to 1D with a diving gas whose mixture ratio is the same as that set by the simulation.

Next, the mixture ratios of diving gases for the cylinders 1A to 1D that are to be used are set in the dive computer 4. Based on the dive time, depth value, and the like, the user also selects the settings for reporting the switch timing by which the gas cylinders are switched. Here, the setting of data in the dive computer 4 is described. First, the setting of the mixture ratio for the diving gas is described. The relationship between the oxygen mixture ratio $FO_2$, nitrogen mixture ratio $FN_2$, and helium mixture ratio FHe is as follows.

$$F02+FN2+FHe=100\%$$

Therefore, if the user sets the mixture ratios for oxygen $O_2$ and helium He, the mixture ratio for nitrogen $N_2$ can be automatically calculated by the automatic calculator unit on the basis of the mixture ratios for oxygen $O_2$ and helium He.

Taking oxygen deficiency during the dive into consideration, a setting range of 8 to 99% (a low setting value for the oxygen mixture ratio is used to prevent oxygen poisoning in deep locations) is used for setting the oxygen mixture ratio $FO_2$ so that an excessively low value cannot be input. As a result, the ROM 53 functions as an input range storage unit, and CPU 51 limits the setting range to this range on the basis of the stored input range. A setting range of 0 to 99% is used for setting the helium mixture ratio FHe.

In this case, because oxygen deficiency occurs at a low oxygen ratio, and the danger of oxygen poisoning increases with depth at higher concentrations, an arrangement is adopted in which the settings are always selected by the user and no automatic setting is performed so that the settings for the helium mixture ratio FHe and the automatically set nitrogen mixture ratio $FN_2$ are not affected. In other words, the priority level that is set for each diving gas in advance is stored, and, based on the stored priority level, priority is given to the setting for the mixture ratio of the diving gas that has a higher priority level, and the mixture ratio of the diving gas with a lower priority level is corrected.

In this case, the input range of the mixture ratio allowed for each diving gas is stored in advance, as shown in FIG. 7, and, based on the stored input range and the setting value for the mixture ratio of the diving gas with a high priority level, the input range of the mixture ratio for the diving gas with a low priority level is corrected. CPU 51 therefore comprises an input range correcting unit.

Figure 8:
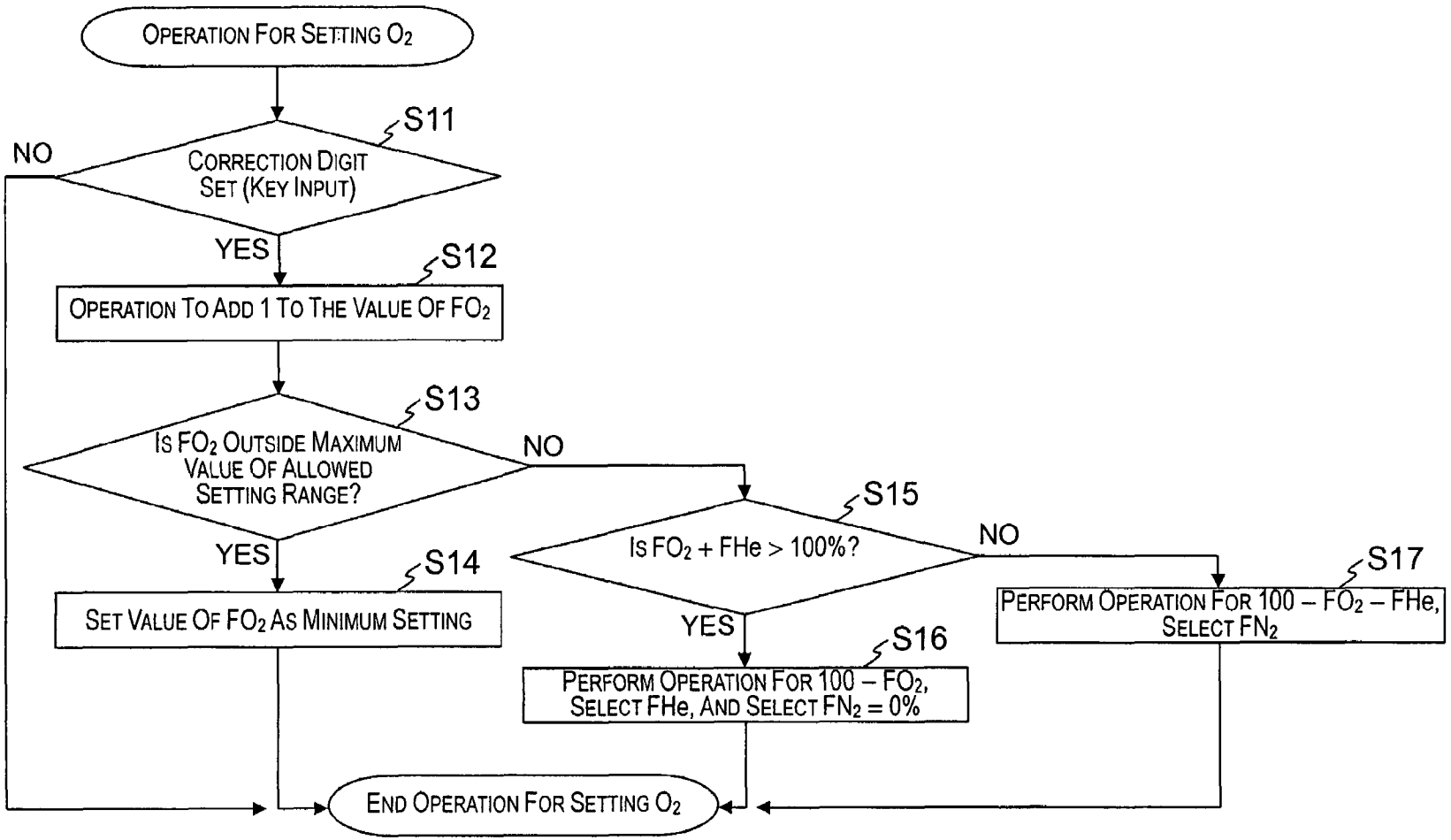
FIG. 8 is a processing flow chart for setting the oxygen mixture ratio in the first embodiment of the invention.
Figure 9:
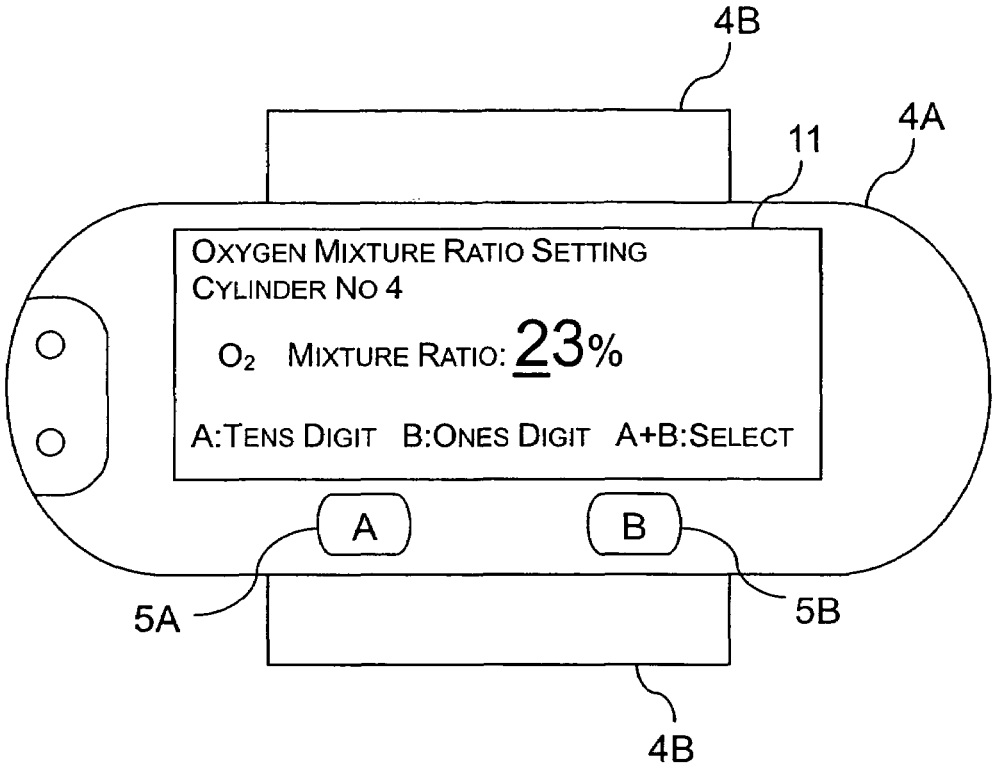
FIG. 9 is a diagram illustrating the display screen (version 1) during the setting of the oxygen mixture ratio in the first embodiment of the invention.
Figure 10:
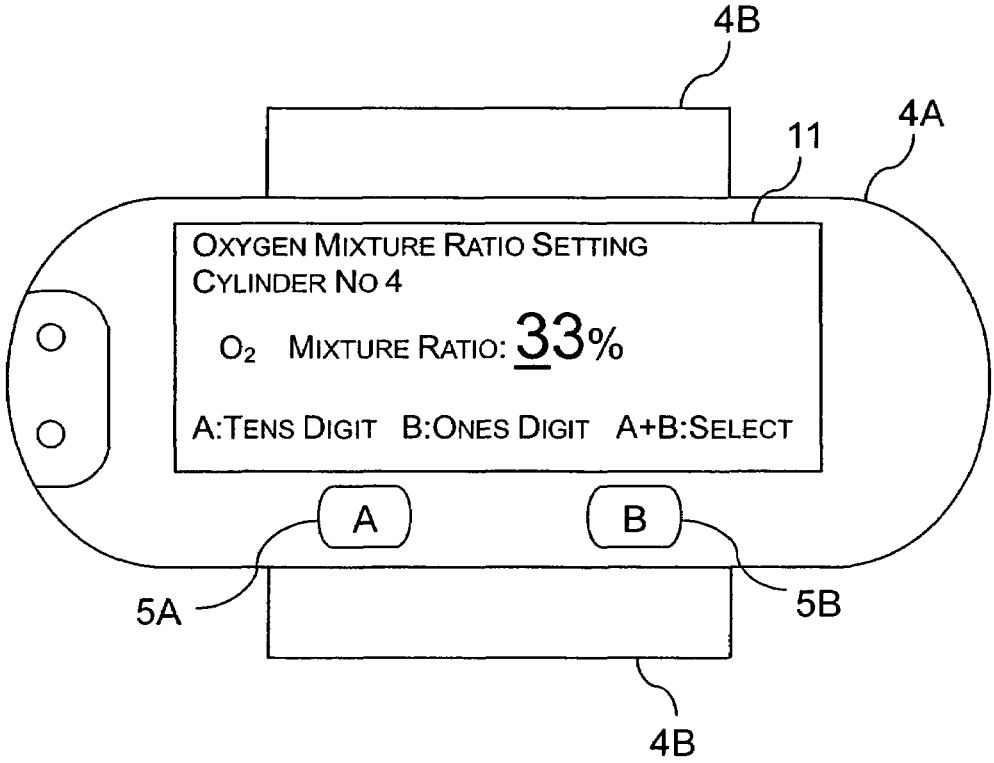
FIG. 10 is a diagram illustrating the display screen (version 2) during the setting of the oxygen mixture ratio in the first embodiment of the invention.

The processing for setting the oxygen mixture ratio is described first. FIG. 8 is a processing flow chart for setting the oxygen mixture. FIG. 9 is a diagram illustrating the display screen (version 1) during the setting of the oxygen mixture ratio. FIG. 10 is a diagram illustrating the display screen (version 2) during the setting of the oxygen mixture ratio.

The description that follows is one in which the oxygen mixture ratio is set for cylinder 1D, which is assigned the cylinder number 4, and the oxygen mixture ratio setting screen is displayed in advance. CPU 51 furthermore functions as an input value correction unit and an oxygen standard ratio calculation unit. In addition, ROM 53 functions as an input range storage unit.

First, the CPU 51 of the dive computer 4 determines whether the correction digit of the oxygen mixture ratio setting has been set via the operating section 5 that functions as a mixture ratio input unit (step S11). More specifically, the cursor is moved to the tens place by depressing the control switch 5A, as shown in FIG. 8, and the correction digit (in this case, the tens place) is selected.

When the correction digit is not set in the determination of step S11 (step S11; No), CPU 51 ends processing for setting the oxygen mixture ratio.

When the correction digit is set in the determination step S11 (step S11; Yes), CPU 51 adds one to the value of the mixture ratio $FO_2$ for oxygen $O_2$ (step S12).

More specifically, when the initial state is a state such as that shown in FIG. 9, the value of the tens place is changed from "2" to "3," as shown in FIG. 10.

Next, CPU 51 determines whether the mixture ratio $FO_2$ for oxygen $O_2$ has exceeded the maximum value of the allowed setting range (step S13).

In the case that it has been determined in the determination step S13 that the mixture ratio $FO_2$ for oxygen $O_2$ has exceeded the maximum value of the allowed setting range, CPU 51 sets the mixture ratio $FO_2$ for oxygen $O_2$ to the minimum value of the allowed setting range (step S14), and CPU 51 ends processing for setting the oxygen mixture ratio. In the specific example shown in FIG. 7, CPU 51 sets the mixture ratio $FO_2$ for oxygen $O_2$ to 16% at a depth region of 40 to 60 m in depth.

In the case that it has been determined in the determination step S13 that the mixture ratio $FO_2$ for oxygen $O_2$ is equal to or less than the maximum value of the allowed setting range, CPU 51 determines whether the sum of the mixture ratio FHe for helium He and the mixture ratio $FO_2$ for oxygen $O_2$ has exceeded 100% (step S15).

In the case that it has been determined in the determination step S15 that the sum of the mixture ratio $FO_2$ for oxygen $O_2$ and the mixture ratio FHe for helium He has exceeded 100% (step S15; Yes), CPU 51 selects the mixture ratio FHe for helium He, selects the mixture ratio $FN_2$ for nitrogen $N_2$ at 0%

(step S16) in accordance with the following expression, and ends processing for setting the oxygen mixture ratio.

$$FHe=100-FO_2\ (\%)$$

In the case that it has been determined in the determination step S15 that the sum of the mixture ratio $FO_2$ for oxygen $O_2$ and the mixture ratio FHe for helium He is 100% or less (step S15; No), CPU 51 selects the mixture ratio $FN_2$ for nitrogen $N_2$ in accordance with the following expression (step S17), and ends processing for setting the oxygen mixture ratio.

$$FN_2=100-FO_2-FHe(\%)$$

Figure 11:
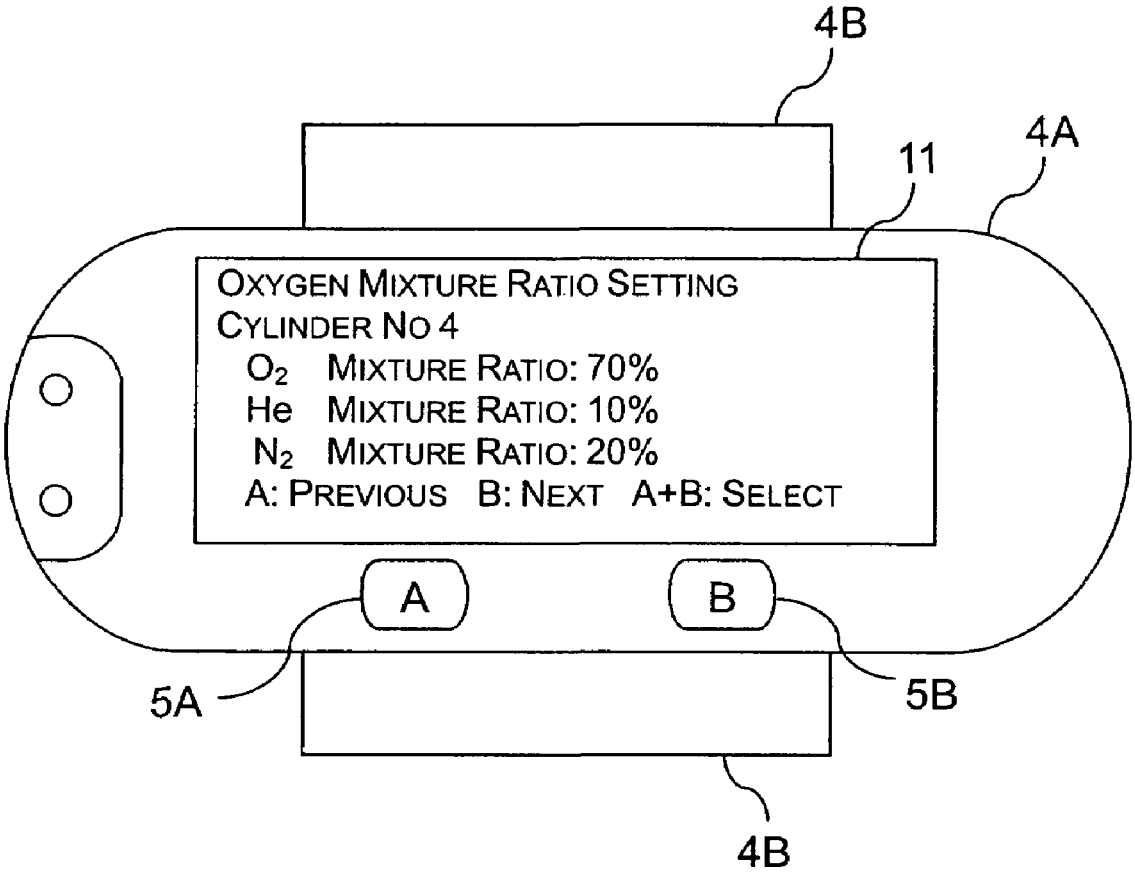
FIG. 11 is a diagram illustrating a display screen after the setting of the oxygen mixture ratio in the first embodiment of the invention.

FIG. 11 is a diagram illustrating a display screen after the setting of the oxygen mixture ratio.

When the processing for the oxygen mixture ratio ends, the cylinder number, the mixture ratio $FO_2$ for oxygen $O_2$, the mixture ratio FHe for helium He, and the mixture ratio $FN_2$ for nitrogen $N_2$ are displayed, as shown in FIG. 11.

Figure 12:
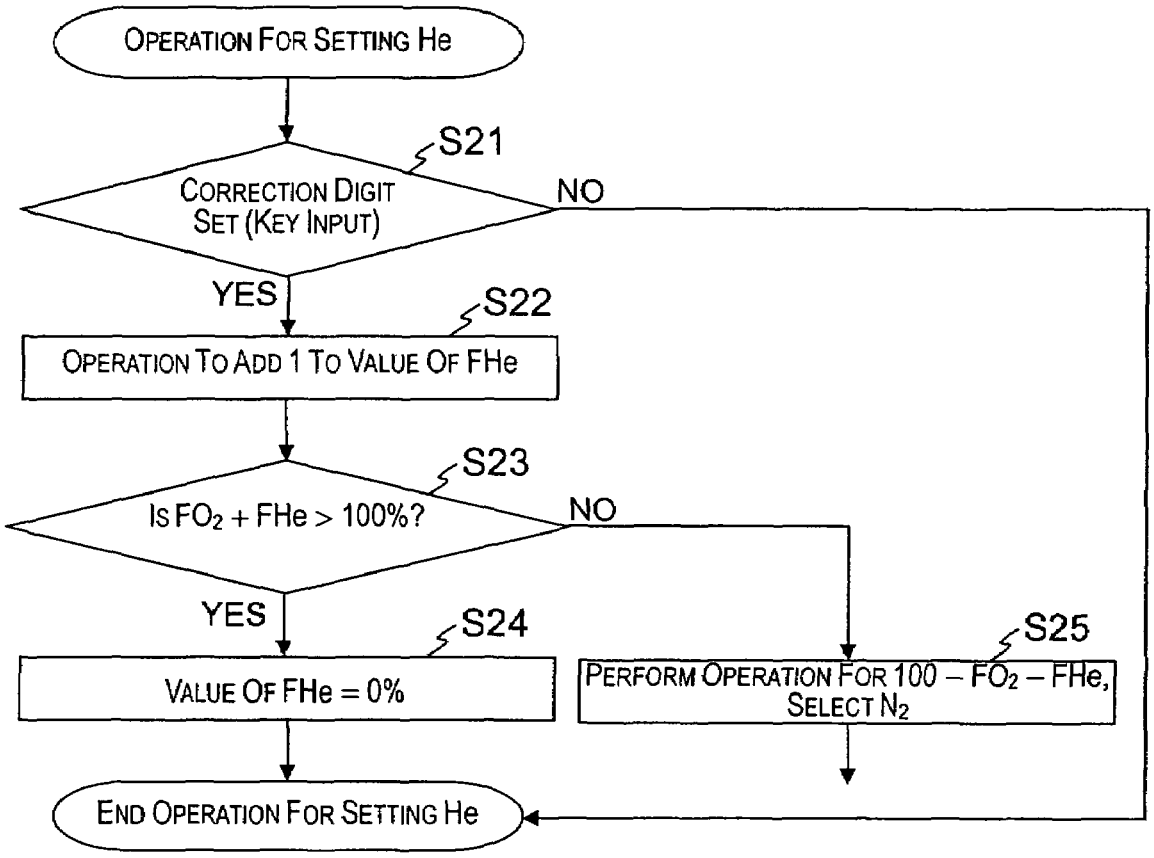
FIG. 12 is a processing flow chart for setting the helium mixture ratio in the first embodiment of the invention.

The processing for setting the helium mixture ratio is described next. FIG. 12 is a processing flow chart for setting the helium mixture ratio. First, the CPU 51 of the dive computer 4 determines whether the correction digit of the helium mixture ratio setting has been set via the operating section 5 (step S21).

When the correction digit is not set in the determination of step S21 (step S21; No), CPU 51 ends processing for setting the helium mixture ratio.

When the correction digit is set in the determination step S21 (step S21; Yes), CPU 51 adds one to the value of the mixture ratio for helium He (step S22).

Next, CPU 51 determines whether the sum of the mixture ratio $FO_2$ for oxygen $O_2$ and the mixture ratio FHe for helium He has exceeded 100% (step S23).

In the case that it has been determined in the determination step S23 that the sum of the mixture ratio $FO_2$ for oxygen $O_2$ and the mixture ratio FHe for helium He is 100% or more (step S23; Yes), CPU 51 selects the mixture ratio FHe for helium He at 0% (step S24), and ends processing for setting the helium mixture ratio.

In the case that it has been determined in the determination step S23 that the sum of the mixture ratio $FO_2$ for oxygen $O_2$ and the mixture ratio FHe for helium He is less than 100% (step S23; No), CPU 51 selects the mixture ratio $FN_2$ for nitrogen $N_2$ in accordance with the following expression (step S25), and ends processing for setting the oxygen mixture ratio.

$$FN_2=100-FO_2-FHe(\%)$$

The operation of the dive computer 4 with the above-described structure is subsequently described.

Figure 13:
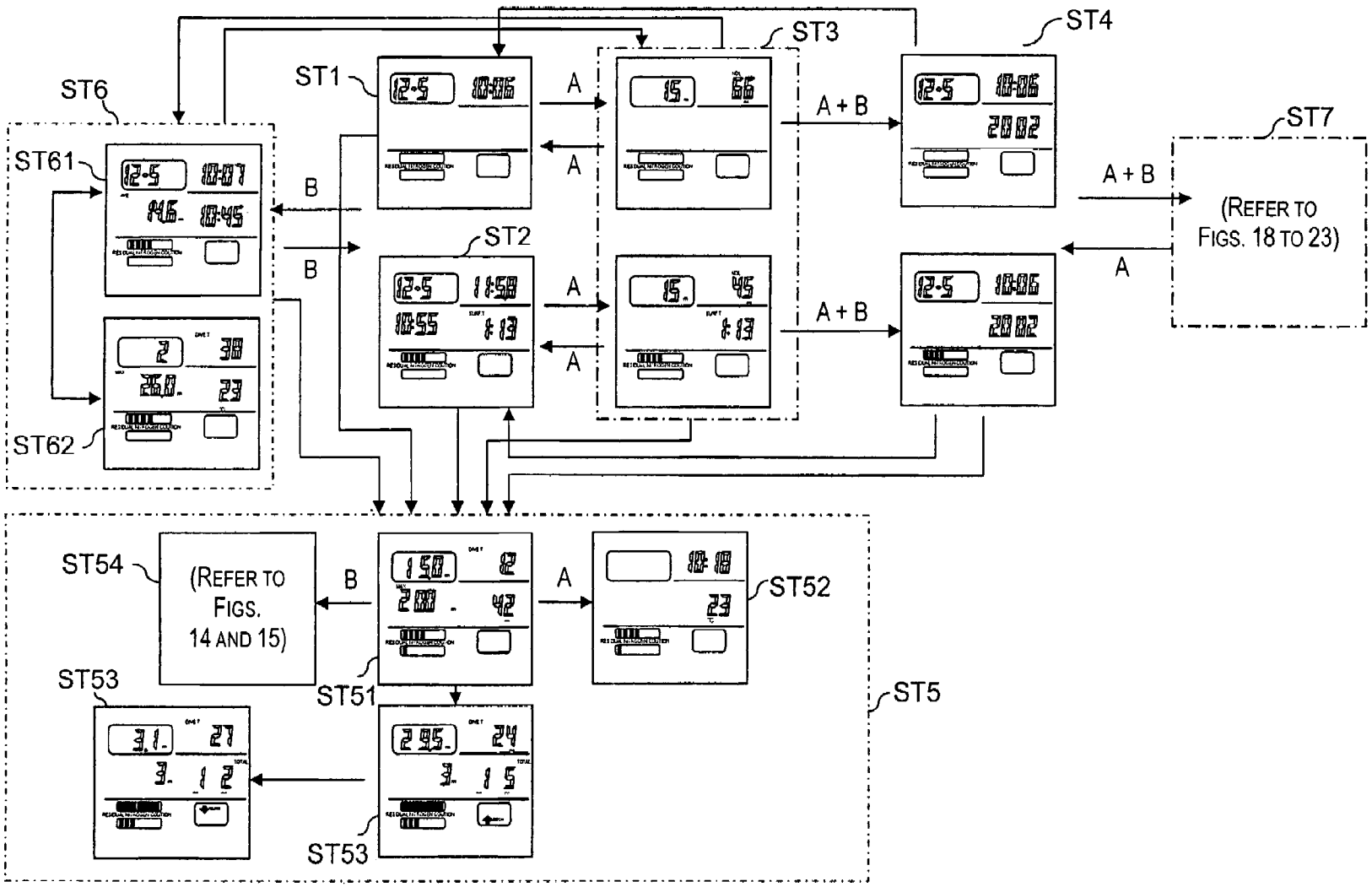
FIG. 13 is a diagram schematically depicting the manner in which the display screen changes its appearance in each of the operating modes of the dive computer in the first embodiment of the invention.

FIG. 13 is a diagram schematically depicting the manner in which the display screen changes its appearance in each of the operating modes of the dive computer 4. As shown in FIG. 13, the dive computer 4 has the following operating modes: a time mode ST1, a surface mode ST2, a planning mode ST3, a setting mode ST4, a diving mode ST5, a log mode ST6, and a cylinder switching condition setting mode ST7.

All the modes are described below. The processing in each of these modes is performed by the control unit 50 described above.

The time mode ST1 does not perform switching operation, but is a mode performed when the computer is carried on land in a state in which the inert gas partial pressure inside the body is balanced. The current month and day, the current time, and the elevation rank are displayed on the liquid crystal display panel in the time mode ST1, as shown in FIG. 13 (refer to key symbol ST1). When the elevation rank is 0, no elevation rank is displayed. More specifically, the display in FIG. 13 signifies that the current month and day is December 5 and the current time is 10:06, and the user can know in particular that the currently displayed time is the current time by the blinking colon (:).

When the switch 5A in this time mode ST1 is pressed, the system shifts to the planning mode ST3, as shown in FIG. 13. When the switch 5B is pressed, the system shifts to the log mode ST6. When the switch 5B is pressed continuously for a predetermined length of time (five seconds, for example), the system shifts to the setting mode ST4 while the switch 5A is being pressed.

The surface mode ST2 is a land-based mode that runs until 48 hours have elapsed since the previous diving, and the dive computer 4 is adapted to automatically shift to the surface mode ST2 when the diving operation monitoring switch 30, which was in a conductive state during diving, enters a non-conductive state after the previous dive is completed. In addition to the current month and day, the current time, and the elevation rank being displayed in the time mode ST1, the time required to purge inert gas from the body is displayed as a countdown in this surface mode ST2. When the time designed to be displayed as the time required for purging inert gas from the body reaches 0 hours and 00 minutes, the system enters a non-display state. The time elapsed after the end of a dive is furthermore displayed as the surface interval in the surface mode ST2. This surface interval is configured so that the clock is started as diving is deemed completed when the depth is shallower than 1.5 meters, and when 48 hours has elapsed after the completion of diving, the system enters and non-display state. Therefore, the dive computer 4 remains in this surface mode ST2 on land until 48 hours has elapsed after the completion of diving, and shifts to the time mode ST1 thereafter.

More specifically, the surface interval is 1 hour and 13 minutes in the surface mode ST2 shown in FIG. 13; that is, the fact that 1 hour and 13 minutes have elapsed since the completion of diving is displayed. The amount of inert gas currently absorbed in the body by diving is displayed as corresponding four lighted marks on the graph of inert gas in the body, and the time that needs to elapse from the current condition until the excess inert gas inside the body is purged and a balanced condition is achieved; in other words, the time required to purge inert gas from the body is 10 hours and 55 minutes, is displayed.

When the switch 5A is pressed in this surface mode ST2, the system shifts to the planning mode ST3, as shown in FIG. 13. When the switch 5B is pressed, the system shifts to the log mode ST6. When the switch 5B is pressed continuously for a predetermined length of time (five seconds, for example), the system shifts to the setting mode ST4 while the switch 5A is being pressed.

The planning mode ST3 is an operating mode in which the approximate maximum depth and dive time for the next dive can be input before the dive. The depth rank, the time during which diving without decompression is possible, the surface interval, and the graph of inert gas in the body are displayed in this planning mode ST3. The depth ranks are configured so that the display changes successively at predetermined time intervals. The depth ranks include, for example, 9 m, 12 m, 15 m, 18 m, 21 m, 24 m, 27 m, 30 m, 33 m, 36 m, 39 m, 42 m, 45 m, and 48 m; and the display thereof is configured so as to refresh every five seconds. In the case that the system has shifted from the time mode ST1 to the planning mode ST3, and in the case that there is no excessive nitrogen accumulation in the body due to previous diving, in other words, because the system is in the planning mode for the first dive, the number of lighted marks displayed on the graph of inert gas in the body is 0; more specifically, the time during which diving without decompression is possible is displayed as 66 minutes when the depth is 15 m, as shown in FIG. 13 (refer to key symbol ST4). This represents the fact that diving without decompression is possible for less than 66 minutes at depth of 12 m or more and 15 m or less.

In contrast, if the system has shifted from the surface mode ST2 to the planning mode ST3, four lighted marks are displayed in the graph of insert gas in the body, and the time during which diving without decompression is possible is displayed as 45 minutes in the case that the depth is 15 m, for example, because planning is being carried out for repeated diving in which there is excessive accumulation of inert gas in the body due to previous diving, as shown in FIG. 13. This represents the fact that diving without decompression is possible for less than 45 minutes at depth of 12 m or more and 15 m or less. In the interval of time that the depth rank is successively displayed from 9 m to 48 m in this planning mode ST3, the system will shift to the surface mode ST2, as shown in FIG. 13, when the switch 5*a* is continuously pressed for two seconds or more. The system automatically shifts to the time mode ST1 or the surface mode ST2 after the depth rank is displayed as 48 m. When the switches are not operated for a predetermined interval of time in this manner, the system automatically shifts to the time mode ST1 or the surface mode ST2, so it is convenient for the diver that there is no need to operate switches to reach these modes. When the switch 5B is pressed, the system shifts to the log mode ST6.

In addition to setting the current month and day, and the current time, the setting mode ST4 is an operating mode for setting the warning alarm ON/OFF and setting the safety level. The safety level (not depicted), the alarm ON/OFF (not depicted), and the elevation rank (not depicted) are displayed in addition to the current month and day, the current year, and the current time in this setting mode ST4. Of these display items, it is possible to select one of two safety levels: a level for carrying out normal decompression calculation, and a level for carrying out decompression calculation presuming that the diver moves to a location that is one rank higher in elevation after diving. In the case that excessive inert gas has accumulated in the body from previous diving, the graph of inert gas in the body is displayed. The alarm ON/OFF is a function for setting the option of sounding a warning alarm from a reporting device (e.g., the sound alarm 37 and/or the oscillation generator 38), and the alarm does not sound when the alarm is set to OFF. This is advantageous in devices in which battery power loss must be avoided to the extent possible, as in an information processing device for a diver, because inadvertent battery power loss from the consumption of power by the alarm can be avoided. The alarm is turned ON when the ascent velocity is violated, during decompression diving, and in other critical diving situations.

The setting items consecutively change in the order of hour, second, minute, year, month, day, safety level, and alarm ON/OFF each time the switch 5A is pressed in the setting mode ST4, and the display of the area with the item to be set blinks. When the switch 5B is pressed at this time, the numerical value or the character changes, and when continuously pressed, the numerical values or the characters of the setting items change quickly. When the switch 5A is pressed when alarm ON/OFF is blinking, the system returns to the time mode ST1 or the surface mode ST2. When the switches 5A and 5B are pressed simultaneously when the alarm ON/OFF is blinking, the system shifts to the cylinder switching condition setting mode ST7. If neither of the switches 5A and 5B is operated for a predetermined interval of time (1 to 2 minutes, for example), the system automatically returns to the time mode ST1 and the surface mode ST2.

The diving mode ST5 is an operation mode used during diving, and comprises a non-decompression diving mode ST51, a current time display mode ST52, a decompression diving mode ST53, and a cylinder switch control mode ST54.

The current depth, the dive time, the maximum depth, the time during which diving without decompression is possible, the graph of the inert gas in the body, the elevation rank, and other information required in diving are displayed in the non-decompression diving mode ST51.

In the non-decompression diving mode ST51 shown in FIG. 13 in the above-described example, the display shows the fact that 12 minutes have elapsed since diving began, the diver is currently at a depth of 15.0 m, and diving without decompression can continue for another 42 minutes at this depth. Also displayed is the maximum depth until the current point in time, which is 20.0 m, and four lighted marks in the graph showing the current amount of inert gas in the body are lighted to show the level.

When the switch 5A is pressed in the diving mode ST5, and only while the switch 5A is continuously pressed, the system shifts to the current time display mode ST52, and the current time and current temperature are displayed. More specifically, displayed in the current time display mode ST52 shown in FIG. 13 is the current time is 10:18, and the current temperature is 23° C. Thus, when the switches are operated in the diving mode ST5, the current time and current temperature are displayed for a predetermined interval of time, so even if the system is configured to normally display solely the data required in diving within a small display screen, it is convenient because the current time and other information can be displayed as needed. Because switch operation is used to switch between displays even in the diving mode ST5 in such a manner, the information desired by the diver can be displayed with reasonable timing.

When the diver has ascended to a depth the is shallower than 1.5 m in the diving mode ST5, it is determined that diving is completed; and when the diving operation monitoring switch 30, which was conductive during the dive, becomes nonconductive, the system automatically shifts to the surface mode ST2. The interval from the time at which the depth is 1.5 m or more to the time at which the depth is again less 1.5 m is defined as a single diving action, and the diving results (the diving date, dive time, maximum depth, and other data) during this interval of time are stored in the RAM 54.

The dive computer 4 of the present embodiment is configured under the assumption of non-decompression diving, but when decompression diving is required, the relevant alarm is turned on, the diver is informed, and the system shifts the operating mode to the decompression diving display mode ST53.

The current depth, dive time, graph of the inert gas in the body, elevation rank, decompression stop depth, decompression stop time, and total ascent time are displayed in the decompression diving display mode ST53. More specifically, the fact that the 24 minutes have elapsed since the start of the dive, and that the diver is at a depth of 29.5 m is displayed in the decompression diving display mode ST53 shown in FIG. 13. Further displayed are instructions that direct the diver to ascend to a depth of 3 m while maintaining a safe ascent velocity, and to carry out a decompression stop for one minute at that point, because the amount of inert gas in the body has exceeded a maximum allowed value and the diver is in danger. The diver carries out a decompression stop based on the content of the display as described above, and ascends thereafter; and the fact that the amount of inert gas in the body is decreasing is displayed by way of a downward-pointing arrow while decompression is being carried out.

When the switch 5B is pressed in the non-decompression diving mode ST51, the system shifts to the cylinder switch control mode ST54.

This cylinder switch control mode ST54 is a mode for informing the diver to refrain from switching when it has been determined that safety cannot be ensured, in other words, that safety cannot be ensured if the system is switched to a new cylinder in the case that a switch from the current diving condition (including the mixed gas ratio of the cylinder in use) to a new cylinder with the same or different mixed gas ratio is made.

Figure 14:
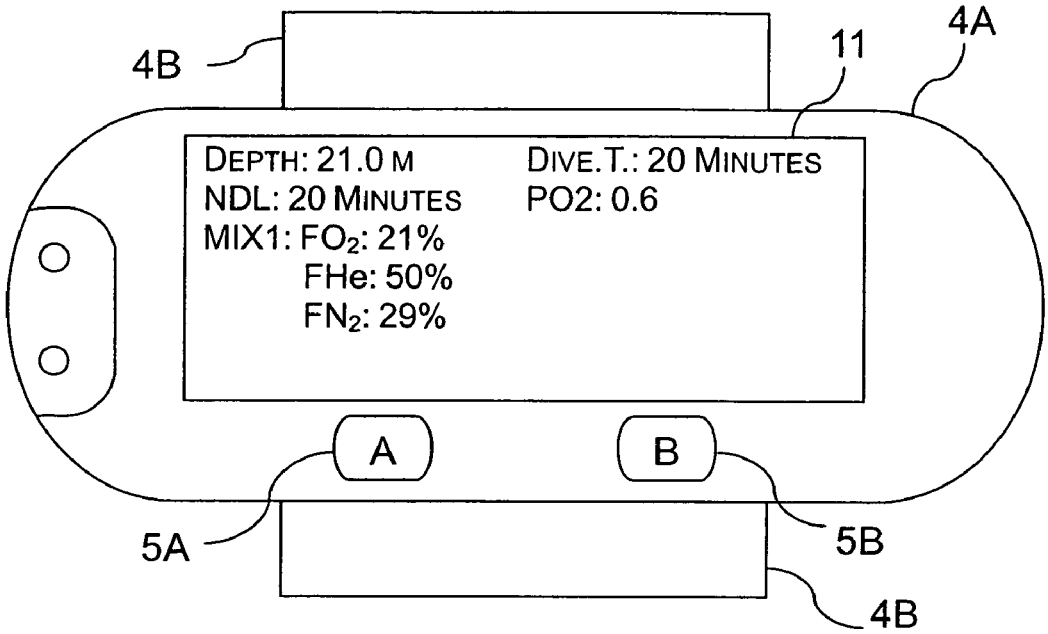
FIG. 14 is a diagram (version 1) of an example of the display screen in a cylinder switch control mode when switching is enabled in the first embodiment of the invention.
Figure 15:
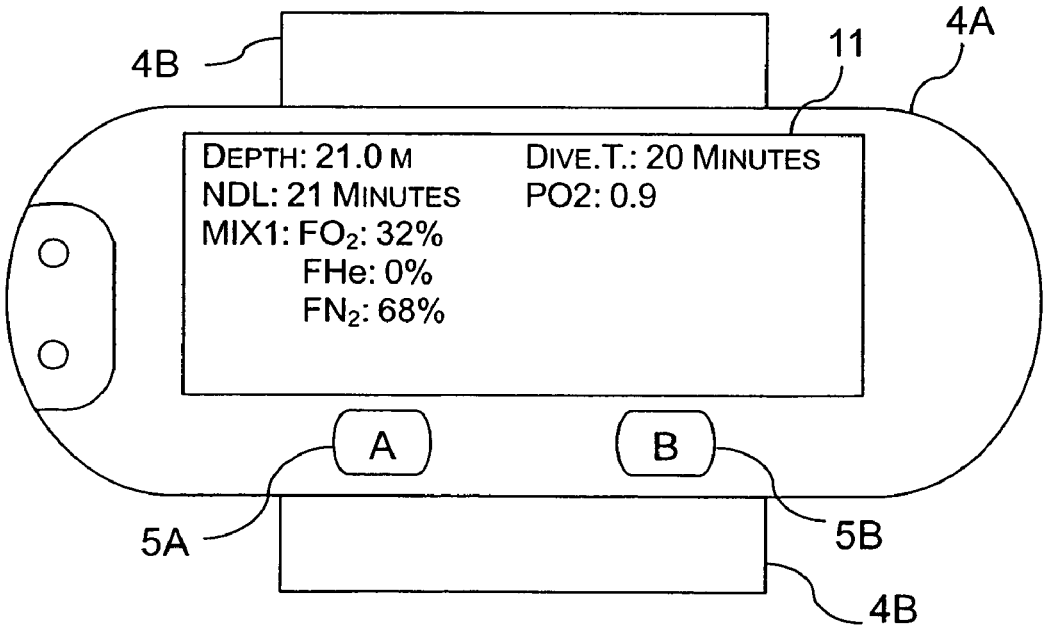
FIG. 15 is a diagram (version 2) of an example of the display screen in the cylinder switch control mode when switching is enabled in the first embodiment of the invention.

FIGS. 14 and 15 are diagrams of an example of the display screen in the cylinder switch control mode ST54 (when switching is enabled).

The current diving condition and the gas mixture ratio of the cylinder currently in use are displayed in the initial state, as shown in FIG. 14. More specifically, a depth of 21 m, a dive time of 20 minutes, a time of 20 minutes during which diving (without decompression) is possible, an oxygen partial pressure of 0.6, and the gas mixture ratio (oxygen: 21%, helium: 50%, nitrogen: 29%) in the cylinder currently being used are displayed.

In this state, the time during which diving is possible until the system is switched to another cylinder, the oxygen partial pressure, and the gas mixture ratio are displayed by repeatedly pressing the switch 5B until the display shows the desired information about the cylinder to which the system is to be switched. More specifically, a depth of 21 m, a dive time of 20 minutes, a time of 21 minutes during which diving (without decompression) is possible, an oxygen partial pressure of 0.9, and the gas mixture ratio (oxygen: 32%, helium: 0%, nitrogen: 68%) in the cylinder to which the switch is to be made are displayed, as shown in FIG. 15.

The diver checks the content in this state, and, if there is no problem, presses switch 5A to cause the dive computer 4 to check the safety of using the cylinder to which the system is to be switched; and if it is determined that there is no problem, the cylinder switch control mode ST54 is ended and the system shifts to the decompression diving mode ST51. The dive computer 4 carries out computations based on information for the cylinder in use after the switch.

Figure 16:
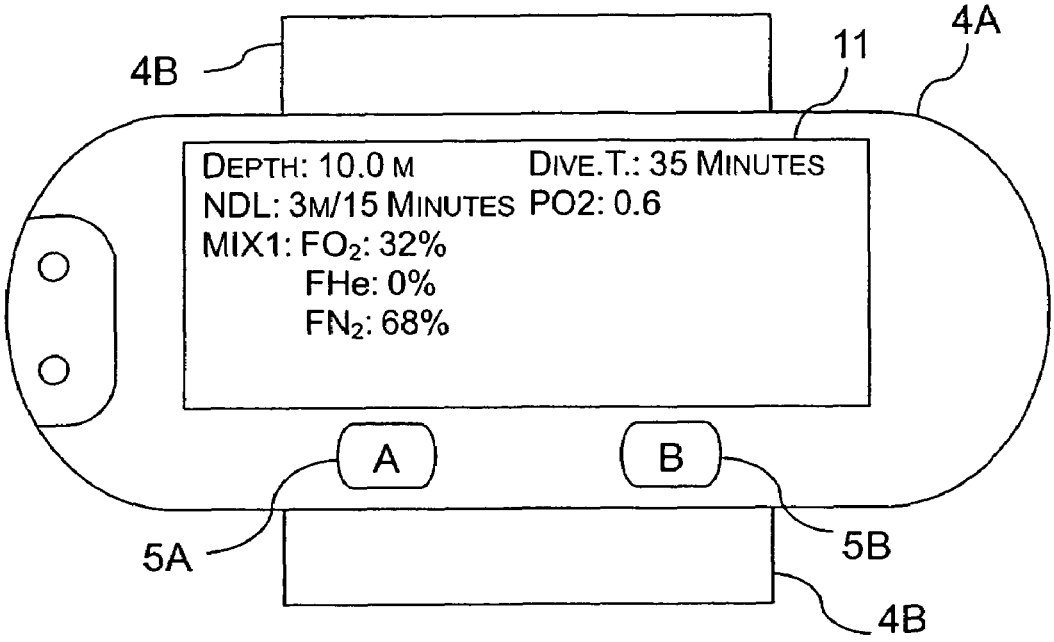
FIG. 16 is a diagram (version 1) of an example of the display screen in the cylinder switch control mode when switching is disabled in the first embodiment of the invention.
Figure 17:
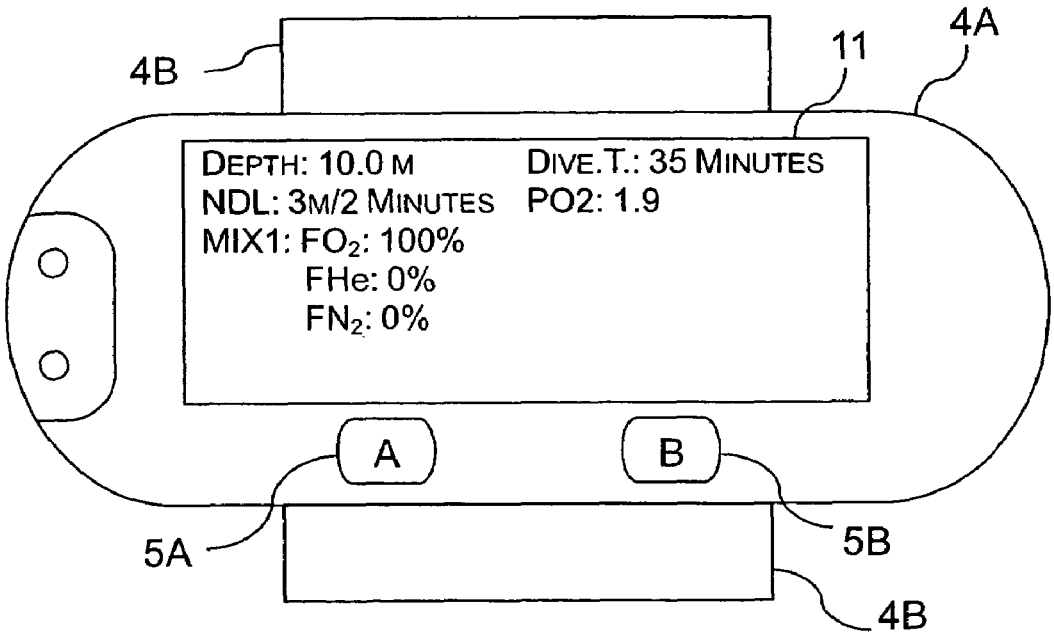
FIG. 17 is a diagram (version 2) of an example of the display screen in the cylinder switch control mode when switching is disabled in the first embodiment of the invention.
Figure 18:
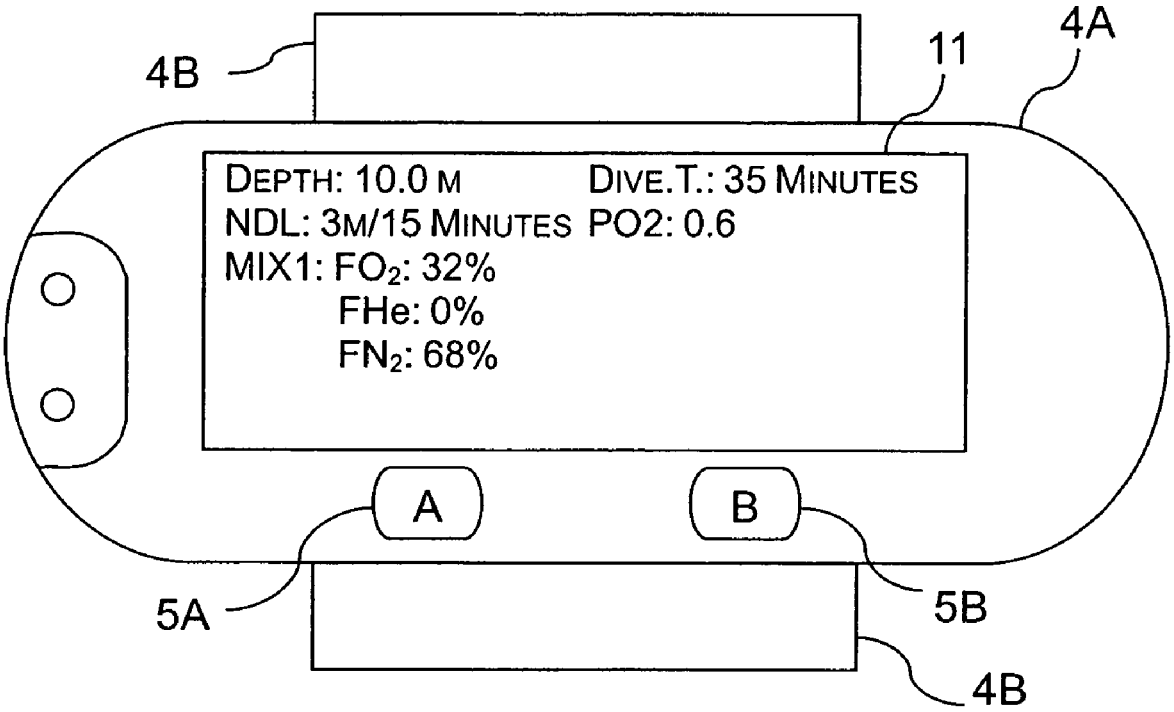
FIG. 18 is a diagram (version 3) of an example of the display screen in the cylinder switch control mode when switching is disabled in the first embodiment of the invention.

FIGS. 16 to 18 are diagrams of an example of the display screen in the cylinder switch control mode (when switching is disabled).

The current diving condition and the gas mixture ratio of the cylinder currently in use are displayed in the initial state, as shown in FIG. 16. More specifically, a depth of 10 m, a dive time of 35 minutes, a decompression diving instruction to remain at 3 m for 15 minutes, an oxygen partial pressure of 0.6, and the gas mixture ratio (oxygen: 32%, helium: 0%, nitrogen: 68%) in the cylinder currently being used are displayed.

In this state, the time during which the dive can be continued with the cylinder to which the system is to be switched, the oxygen partial pressure, and the gas mixture ratio are displayed by repeatedly pressing the switch 5B until the cylinder information of the desired switch destination cylinder is displayed. More specifically, a depth of 10 m, a dive time of 35 minutes, a decompression diving instruction to remain at 3 m for 2 minutes, an oxygen partial pressure of 1.9, and the gas mixture ratio (oxygen: 100%, helium: 0%, nitrogen: 0%) in the cylinder to which the system is to be switched are displayed, as shown in FIG. 17.

The diver checks the content in this state, and, if there is no problem, presses switch 5A, but in this case, the dive computer 4 checks the safety of using the cylinder to which the system is to be switched, and determines that oxygen poisoning may potentially occur when the oxygen partial pressure is high, and the operation of the switch 5A is disabled. The diver can be notified of this by generating an alarm sound with the sound alarm 37, generating an alarm vibration with the oscillation generator 38, or displaying a warning on the liquid crystal display panel.

The dive computer 4 once again displays the current diving condition and the gas mixture ratio of the cylinder being used, as shown in FIG. 18.

The above describes the case of potential oxygen poisoning, but when the oxygen mixture ratio is low, there is danger of oxygen deficiency, so the dive computer 4 generates an alarm sound with the sound alarm 37, generates an alarm vibration with the oscillation generator 38, or displays a warning on the liquid crystal display panel, and does not allow a cylinder switch to be made in such a case.

The log mode ST6 is a function for storing and displaying various data when diving continues for three minutes or more at a depth greater than 1.5 m in the diving mode ST5. Such diving data is consecutively stored for each dive as log data, and log data for a fixed number dives (10 dives, for example) is stored and retained. Here, when the number of dives exceeds the maximum number of stored dives, the newer logs are stored by erasing data in order beginning with old data. Even when the maximum number of stored dives is exceeded, the system may be configured so as to protect a portion of the log data from being erased by way of a preselected setting.

It is possible to shift to this log mode ST6 by pressing switch 5B in the time mode ST1 or the surface mode ST2. The log mode ST6 has two mode screens in which the log data changes every prescribed interval of time (four seconds, for example). The diving month and day, mean depth, diving start time, diving end time, elevation rank, and graph of inert gas in the body at the time the dive ended are displayed in the first log mode ST61, as shown in FIG. 13. The log number showing the dive number on the day that diving was carried out, maximum depth, dive time, water temperature at maximum depth, elevation rank, and graph of inert gas in the body at the time the dive ended are displayed in the second log mode ST62. More specifically, the fact that on the second dive of December 5 with an elevation rank of 0 the dive started at 10:07 and ended at 10:45 for a dive of 38 minutes is displayed, as shown in FIG. 13 (refer to key symbol ST6). Also displayed for this dive are a mean depth of 14.6 m, a maximum depth of 26.0 m, a water temperature of 23° C. at the maximum depth, and that inert gas corresponding to four lighted marks on the graph of inert gas in the body was absorbed.

Because various data can be displayed in this manner while automatically switching between two mode screens in the log mode ST6 of the present embodiment, a considerable amount of data can be essentially displayed even if the display screen is small, and visibility is not reduced.

Data is displayed in order from new data to old data each time the switch 5B is pressed in the log mode ST6, and after the oldest log data is displayed, the system shifts to the time mode ST1 or the surface mode ST2. The system can be shifted to the time mode ST1 or the surface mode ST2 by pressing the switch 5B for two seconds or more, even in a state in which a portion of the entire set of log data has been displayed. Even when either of the switches 5A and 5B has not been operated for a prescribed interval of time (1 to 2 minutes), the operating mode automatically returns to the surface mode ST2 or the time mode ST1. Therefore, the diver is not required to operate the switches and convenience is improved. When the switch 5A is pressed, the system shifts to the planning mode ST3.

The settings for the cylinder switch timing are selected in the cylinder switching condition mode ST7. Information about the use of specific cylinders from among the plurality of cylinders 1A to 1D in accordance with specific timing in order to ensure safe diving must be stored in the dive computer 4 in advance when deep diving or extended diving is performed. As a result, the user of the dive computer 4 selects the item that is a factor in the cylinder switch in the cylinder switching condition setting mode ST7, and inputs the switch condition for the item to the dive computer 4. Therefore, the CPU 51 of the dive computer 4 is basically composed of a condition presentation unit, a selection operation unit, and a switching condition storage unit. CPU 51 is further basically composed of a safety determining unit and a warning unit.

FIG. 19 is a diagram illustrating a table for setting the cylinder switch conditions. Basically, the following five items are preferably set as the items that are factors in cylinder switching, as shown in FIG. 19.

(1) Dive time
(2) Amount of oxygen in the body
(3) Amount of inert gas in the body
(4) Possible dive time
(5) Depth In this case, ten switch conditions that correspond to setting codes 1 to 10 can be set for the switch condition corresponding to the item "Dive time" in the present embodiment. More specifically, these ten switch conditions are a dive time of 0 to 10 minutes (setting code 1), a dive time of 11 to 20 minutes (setting code 2), . . . , and a dive time of 91 minutes to 100 minutes (setting code 10), as shown in FIG. 19.

Four switch conditions that correspond to setting codes 11 to 14 can be set for the switch condition corresponding to the item "Amount of oxygen in the body." More specifically, these four switch conditions are one or two lights in the bar graph for displaying the amount of oxygen in the body (setting code 1), three or four lights in the bar graph for displaying the amount of oxygen in the body (setting code 12), . . . ,and seven or eight lights in the bar graph for displaying the amount of oxygen in the body (setting code 14), as shown in FIG. 19.

Five switch conditions that correspond to setting codes 16 to 20 can be set for the switch condition corresponding to the item "Amount of inert gas in the body." More specifically, these five switch conditions are: one or two lights in the bar graph for displaying the amount of inert gas in the body (setting code 16), three or four lights in the bar graph for displaying the amount of inert gas in the body (setting code 17), . . . , seven or eight lights in the bar graph for displaying the amount of inert gas in the body (setting code 19), and nine lights (setting code 20), as shown in FIG. 19.

Four switch conditions that correspond to setting codes 21 to 24 can be set for the switch condition corresponding to the item "Possible dive time." More specifically, these four switch conditions are a possible dive time of 200 to 151 minutes (setting code 21), a possible dive time of 150 to 101 minutes (setting code 22), . . . , and a possible dive time of 50 minutes to 0 minutes (setting code 10), as shown in FIG. 19.

Nine switch conditions that correspond to setting codes 25 to 33 can be set for the switch condition corresponding to the item "Depth." More specifically, these four switch conditions are a depth of 10 m to 20 m (setting code 25), a depth of 20 m to 30 m (setting code 26), . . . , a depth of 80 m to 90 m (setting code 32), and a depth of 90 m to 100 m (setting code 33), as shown in FIG. 19.

The specific settings for the switch timing are subsequently described with reference to FIGS. 20 to 25. FIG. 20 is a diagram illustrating an example in which cylinder switch timing is set. The cylinder 1A is the cylinder (initially used cylinder) that is used at the start of diving, as shown in FIG. 20.

Figure 21:
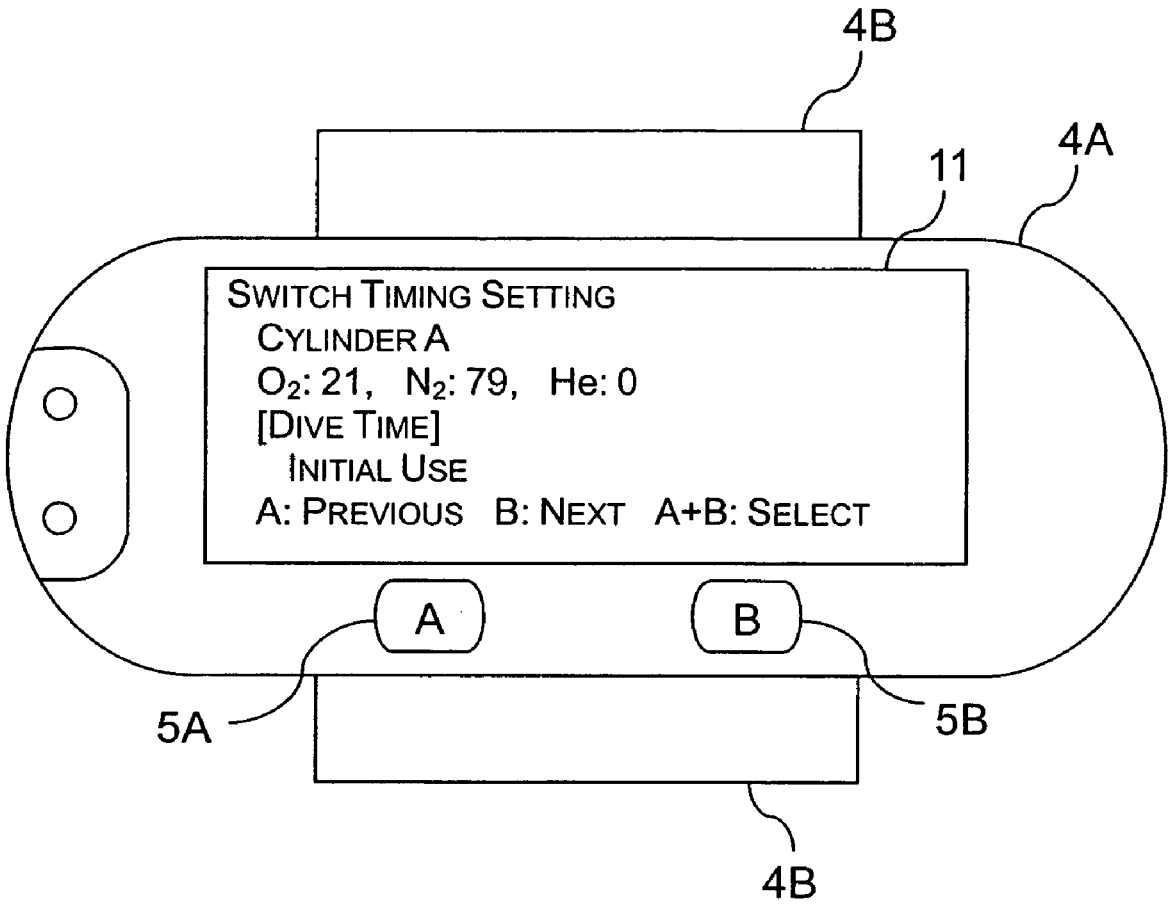
FIG. 21 is an example of a screen for setting the switch timing for cylinder 1A in the first embodiment of the invention, corresponding to the item "Dive time"

FIG. 21 is an example of a screen on which the switch timing is set for cylinder 1A, corresponding to the item "dive time." In the initial state, "Initial use" is displayed in the condition display area. Therefore, the switches 5A and 5B are simultaneously pressed, and the cylinder 1A is confirmed as the initial use cylinder.

The switch timing setting screens for the cylinders 1B, 1C, and 1D are thereby consecutively displayed on the liquid crystal display panel 11, and the procedure is the same for each cylinder. Here, the switch timing setting screen for cylinder 1C (displayed as cylinder C) is described in detail with reference FIGS. 22 to 25.

The cylinder 1C is switched when the conditions for the setting codes 3, 12, 20 and 29 are satisfied. In other words, the switch occurs when the dive time is between 21 and 30 minutes, three or four lights are lighted on the bar graph showing the amount of oxygen in the body, nine lights are lighted on the bar graph showing the amount of oxygen in the body, and the depth is between 50 and 60 m, as shown in FIG. 20.

Figure 22:
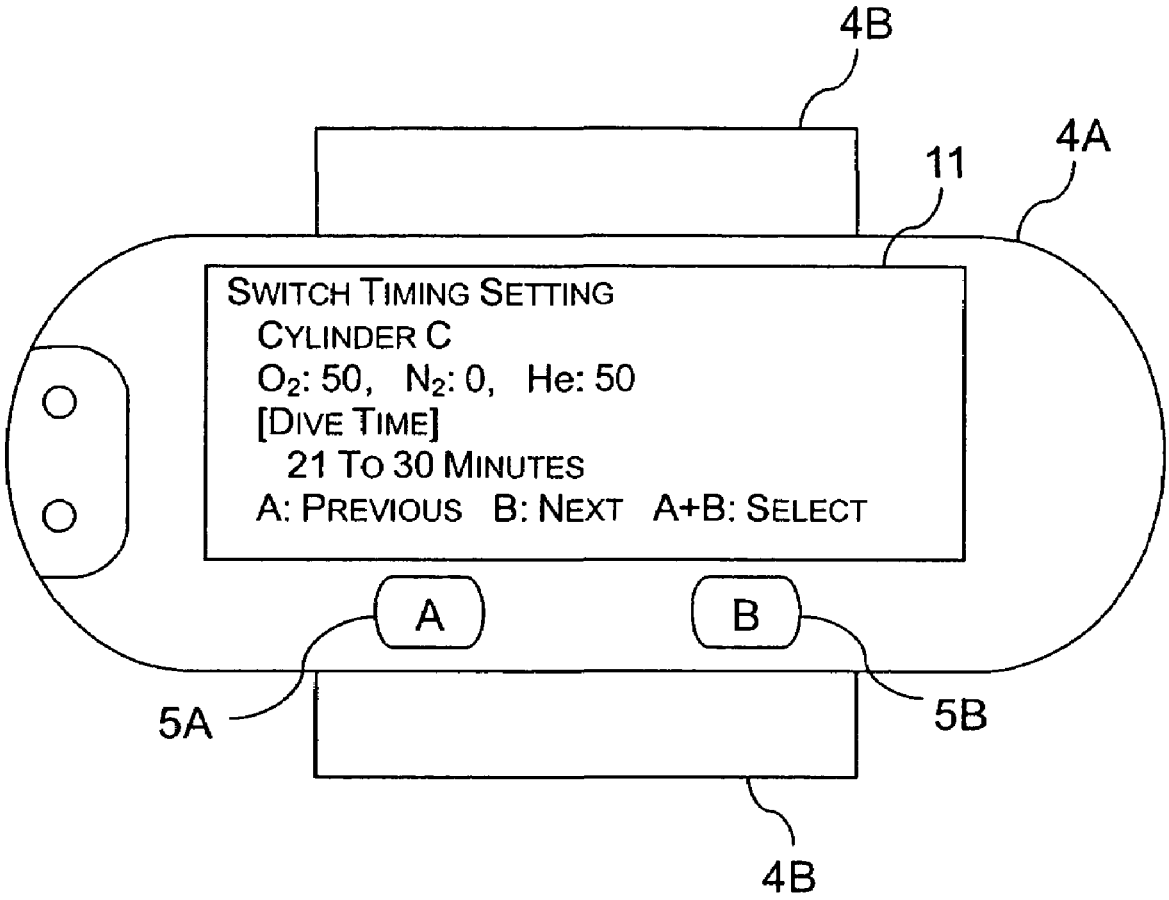
FIG. 22 is an example of a screen for setting the switch timing for cylinder 1C in the first embodiment of the invention, corresponding to the item "Dive time"

FIG. 22 is an example of a screen on which the switch timing is set for cylinder 1C, corresponding to the item "Dive time." In the initial state, "Initial use" is displayed in the condition display area, and when the switches 5B is pressed three times (or switch 5A eight times), "21 minutes to 30 minutes" is displayed in the condition display area. When the switches 5A and 5B are simultaneously pressed in this state, the switch condition in the item "Dive time" for the cylinder 1C is set to a dive time of 21 to 30 minutes.

Figure 23:
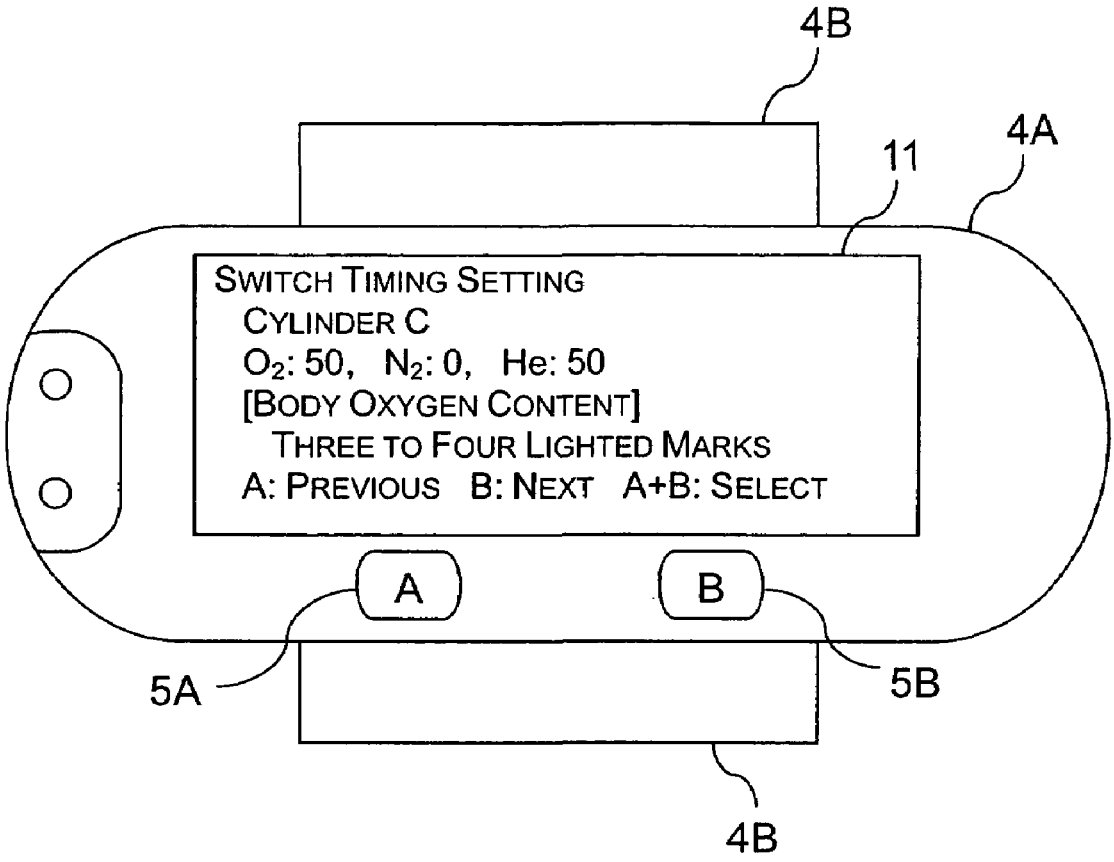
FIG. 23 is an example of a screen for setting the switch timing for cylinder 1C in the first embodiment of the invention, corresponding to the item "Body oxygen content"
Figure 24:
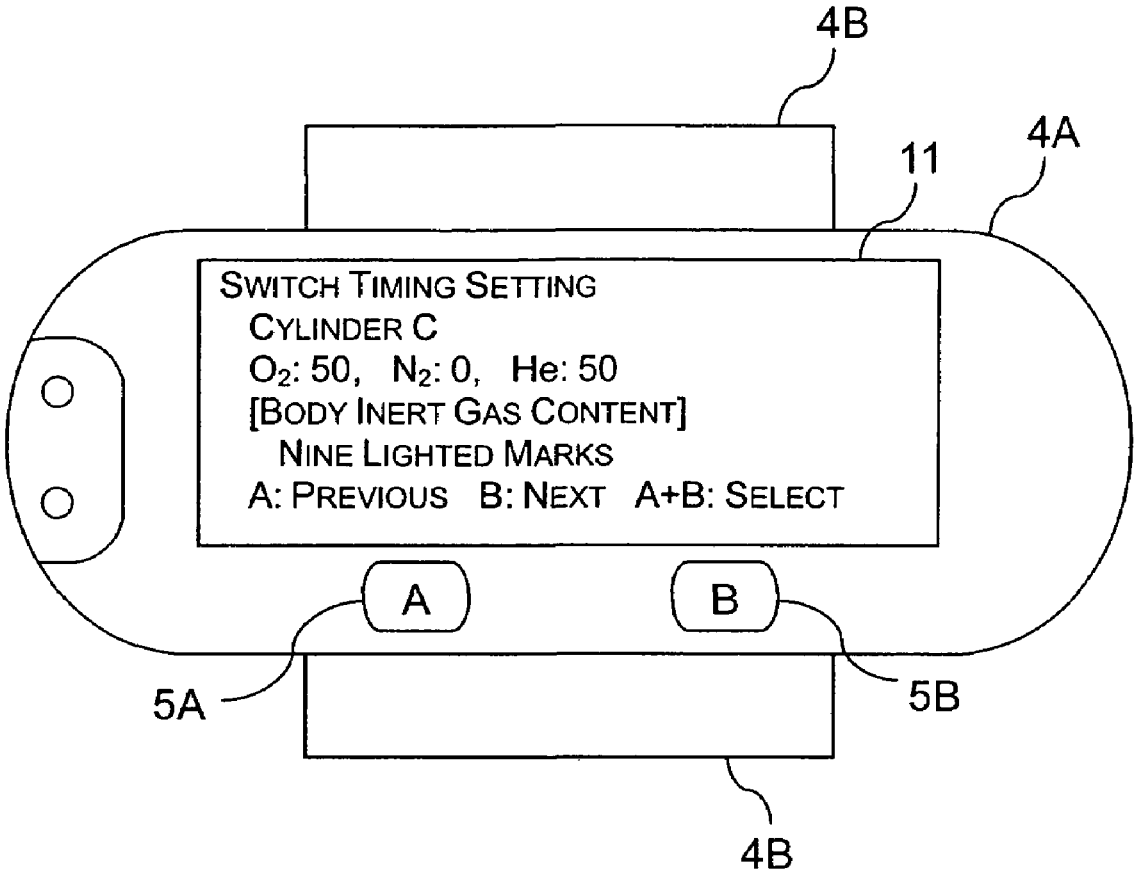
FIG. 24 is an example of a screen for setting the switch timing for cylinder 1C in the first embodiment of the invention, corresponding to the item "Content of inert gas in the body"

FIG. 23 is an example of a screen on which the switch timing is set for cylinder 1C in the first embodiment of the invention, corresponding to the item "Amount of oxygen in the body." In the initial state, one or two lighted marks are displayed in the condition display area, and when the switches 5B is pressed one time (or switch 5A four times), three or four lighted marks are displayed in the condition display area. When the switches 5A and 5B are simultaneously pressed in this state, the switch condition in the item "Amount of oxygen in the body" for the cylinder 1C is set to state in which three or four marks are lighted on the bar graph that displays the amount of oxygen in the body. FIG. 24 is an example of a screen on which the switch timing is set for cylinder 1C in the first embodiment of the invention, corresponding to the item "Amount of inert gas in the body."

In the initial state, one or two lighted marks are displayed in the condition display area, and when the switches 5A is pressed one time (or switch 5B four times), nine lighted marks are displayed in the condition display area. When the switches 5A and 5B are simultaneously pressed in this state, the switch condition in the item "Amount of inert gas in the body" for the cylinder 1C is set to state in which nine marks are lighted on the bar graph that displays the amount of inert gas in the body.

Figure 25:
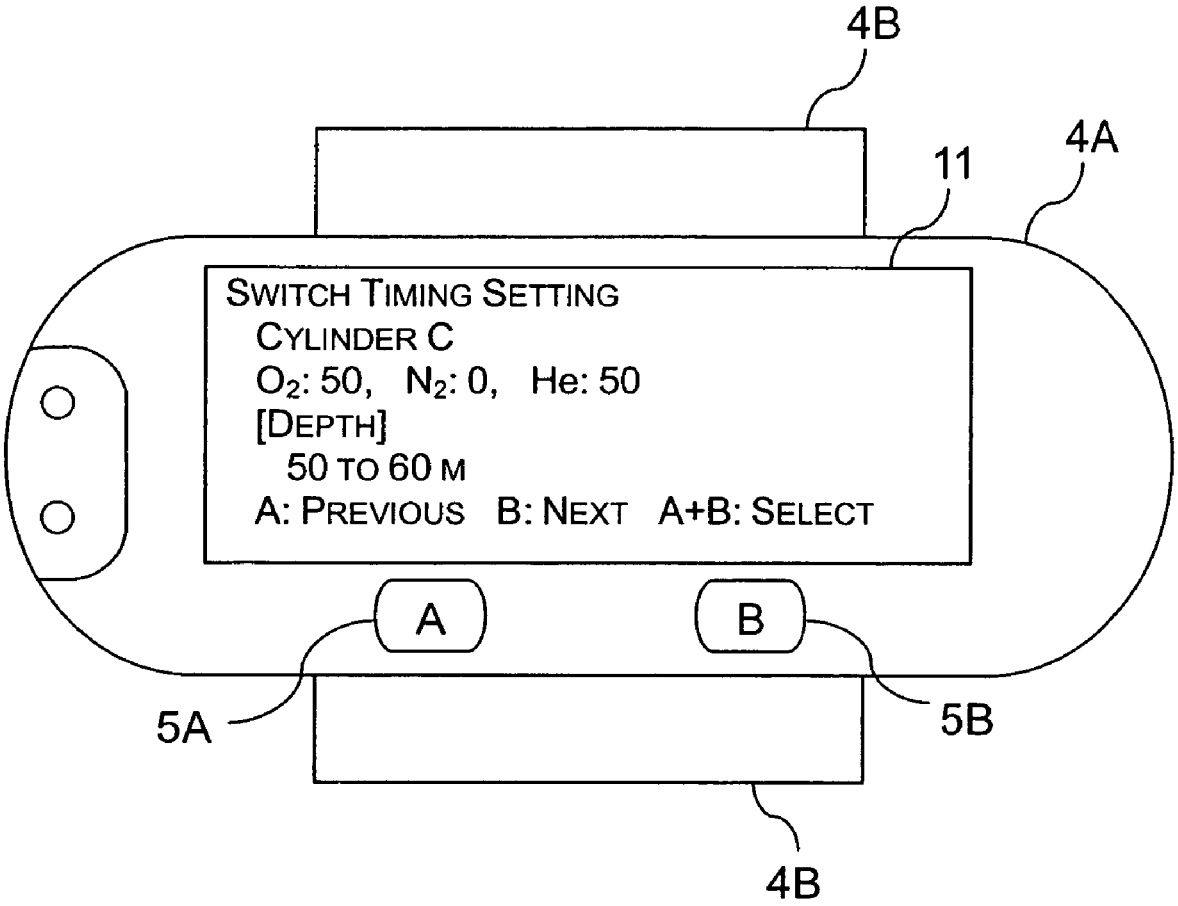
FIG. 25 is an example of a screen for setting the switch timing for cylinder 1C in the first embodiment of the invention, corresponding to the item "Depth"

FIG. 25 is an example of a screen on which the switch timing is set for cylinder 1C, corresponding to the item "Depth." In the initial state, "10 to 20 m" is displayed in the condition display area, and when the switches 5A is pressed four times (or switch 5B four times), "50 to 60 m" is displayed in the condition display area. When the switches 5A and 5B are simultaneously pressed in this state, the switch condition in the item "Depth" for the cylinder 1C is set to a depth of 50 to 60 m.

In the cylinder switching condition setting mode ST7 as described above, the setting can be unerringly performed with simple operation.

The case of actual diving is subsequently described.

Figure 26:
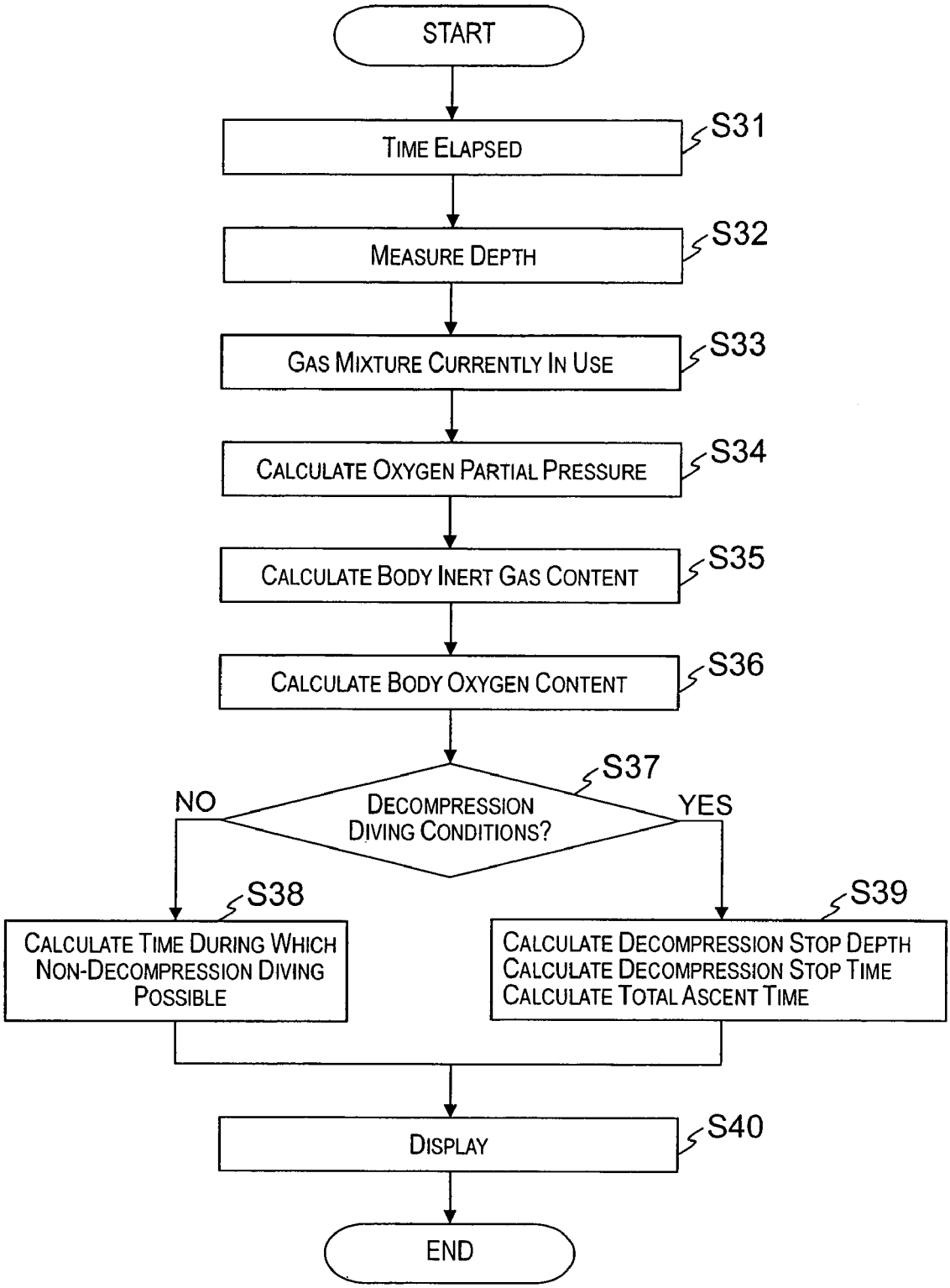
FIG. 26 is a processing flow chart of the dive computer during diving in the first embodiment of the invention.

Because a dive is not carried out to the exact same depth as the previously performed simulation, the dive computer 4 does not immediately provide notification even if the timing for switching cylinders arrives on the basis of the simulation results. In other words, to determine whether it is possible to ensure safety when diving with the mixture ratio of the diving gas in the cylinder to which the system is subsequently switched, it is calculated what the actual oxygen partial pressure will be at the mixture ratio following the cylinder switch, what the allowable non-decompression time is, and what the decompression stop time or decompression stop depth will be when decompression is involved, and the results are displayed on the liquid crystal panel 11. At this point, the CPU 51 of the dive computer 4 functions as a switch timing determination unit and a notification unit. The user then selects the mixture ratio in the appropriate cylinder on the basis of the information displayed on the liquid crystal panel 11, and performs the switch. The specific process for calculating the oxygen partial pressure, the allowable non-decompression time, or the decompression stop time in a decompression condition with the aid of the dive computer 4 during diving is subsequently described. FIG. 26 is a processing flow chart of the dive computer 4 during diving.

First, the CPU 51 of the dive computer 4 measures the time elapsed from the beginning time of the dive on the basis of its own timer (step S31). The depth is then measured (step S32). In this case, the CPU 51 basically constitutes a diving information storage unit.

The CPU 51 thereby reads the mixture ratio of the diving gas that is currently being used (step S3). Here, when calculating the information for the cylinder to which the system is to be switched, the mixture ratio of the diving gas in the selected cylinder to which the switch is to be made is read.

The CPU 51 then calculates the oxygen partial pressure $FO_2$ (step S34).

The CPU 51 next calculates the amount of inert gas in the body (step 35), and the amount of the oxygen in the body (step S36).

After that, the CPU 51 determines whether the diver is in a decompression diving condition on the basis of the diving pattern until the current time (step S37).

In the determination in step S37, the CPU 51 calculates the decompression stop depth, the decompression stop time, and the total ascent time (step S39) when the current diving pattern is a decompression dive (step S37; Yes), and processing shifts to step S40.

In the determination in step S37, the CPU 51 calculates allowable non-decompression stop time (step S38) when the current diving pattern is not a decompression dive (step S37; No).

Based on these results, the CPU 51 will display the decompression stop depth, the decompression stop time, and the total ascent time or the allowable non-decompression time on the liquid crystal display panel 11 of the display unit 10 (step S40).

According to the present first embodiment as described above, the mixture ratios of the diving gases in the plurality of cylinders 1A to 1D are set in accordance with the diving pattern, and the usage timing for each cylinder is simulated before diving. It is also possible to set the switch timing in the dive computer 4 on the basis of the simulation, to allow the dive computer 4 to refer to the actual diving pattern, and to increase diving safety by notifying the diver of the cylinder usage timing (switch timing)

In actual diving, switching instructions are unerringly provided by the information processing device to the diver when a plurality of cylinders 1A to 1D with the same or different mixture ratios of diving gas are switched with a switching device, and the gas is supplied to the diver by way of the regulator 2. Therefore, it is possible to hold the occurrence of oxygen deficiency, oxygen poisoning, nitrogen poisoning, or decompression sickness in check, even when carrying out deep diving. A determination as to whether it is safe to switch cylinders can unerringly be made because the allowable non-decompression time for the mixture ratio of the diving gas to which the diver will switch is calculated, as is the required time and depth required for a decompression stop during decompression diving.

The information processing device related to the present embodiment is further capable of providing instructions as to the allowable non-decompression time, or the time and depth required for a decompression stop, with respect to the mixture ratio of the diving gas, and ensures safe diving while holding oxygen poisoning, nitrogen poisoning, or decompression sickness in check.

Setting the mixture ratio of the diving gas in the information processing device of the present embodiment can be achieved with both high operability and safety because input is simple and resistant to errors.

In the description above, oxygen, nitrogen, and helium are used as the diving gases, but it is also possible to use combinations of oxygen, nitrogen, and hydrogen, or other known diving gases in accordance with the diving conditions.

Also in the description above, the case in which three types of diving gas are used is described, but it is also possible to configure the diving gas to include four or more types of gas. In such a case, it is possible to appropriately select from hydrogen, neon (Ne), argon (Ar), krypton (Kr), xenon (Xe), and the like to serve as diving gas.

Additionally, a configuration in which the diver switched the cylinders was adopted in the description above, but it is also possible to configure the system to wait for instructions from the diver and then automatically carry out the switch. Naturally in this case, it is preferable to provide a configuration that allows manual switching in case of emergency. The dive computer 4 must also be configured so as to generate an alarm sound with a sound alarm, generate an alarm vibration with an oscillation generator, or display a warning on a liquid crystal display panel, and to prohibit automatic cylinder switching when there is danger of oxygen poisoning, and when there is a possibility of oxygen deficiency.

Second Embodiment

A second embodiment of the present invention will be subsequently described with reference to FIGS. 27 and 28. The second embodiment is one in which an ascent/decent control function is incorporated into the dive computer 4 of the first embodiment. Other than a configuration whereby the control unit 50 implements the ascent/descent control function in this case, the configuration of the dive computer 4 is basically the same as the first embodiment, so the description will refer to the diagrams of the first embodiment as needed.

Figure 27:
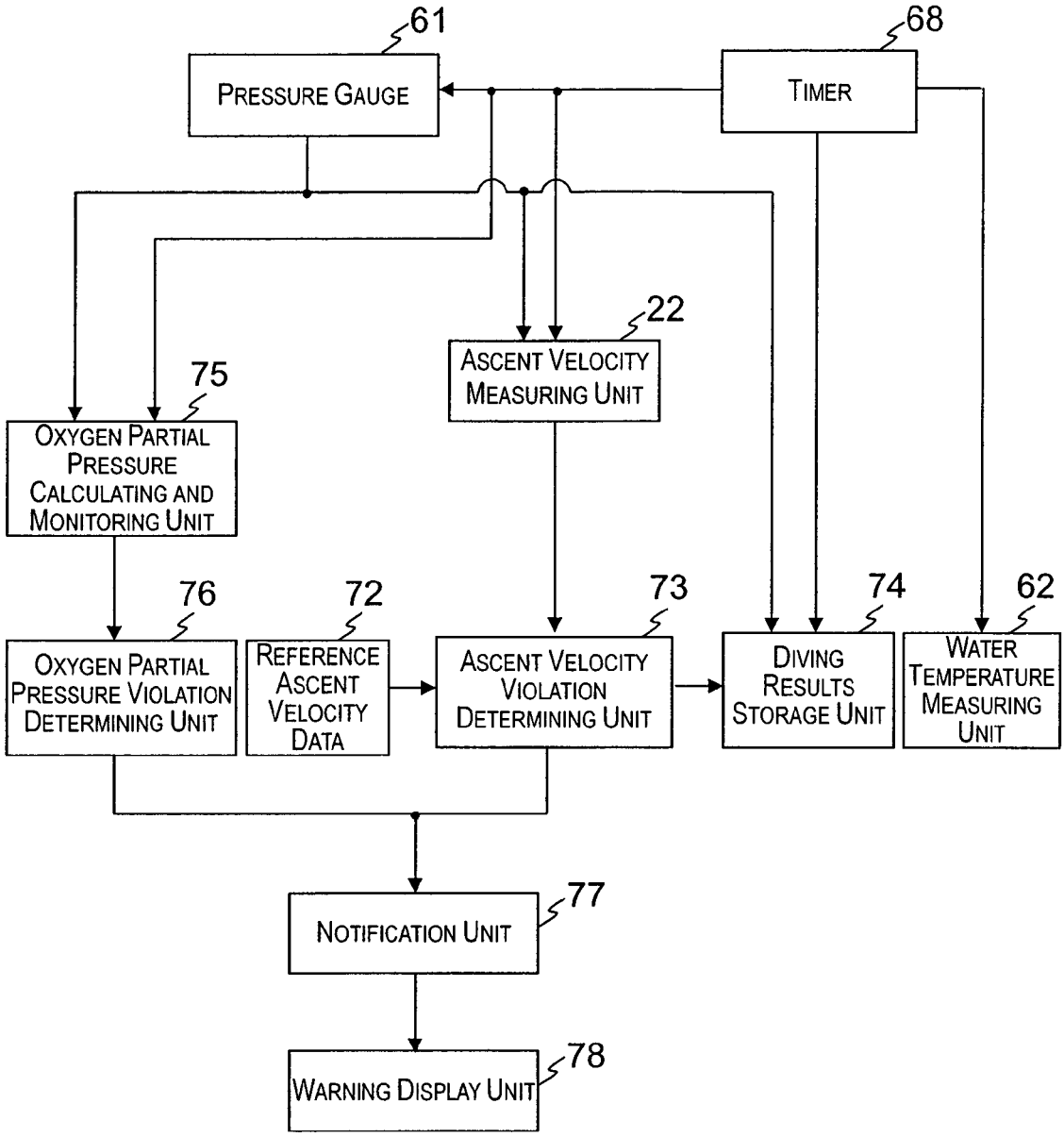
FIG. 27 is a functional block diagram for implementing the function of ascent velocity monitoring in a second embodiment of the invention.

FIG. 27 is a functional block diagram for implementing the function of ascent velocity monitoring that is included in the ascent/descent control function of the second embodiment. In addition to the dive computer 4 shown in FIG. 5, the dive computer 4 of the second embodiment is configured so as to monitor the ascent velocity of the diver in the diving mode. This ascent/descent control function is implemented by way of the configuration below in which the functions of the CPU 51, ROM 53, RAM 54, and other components that comprise the control unit 50 are used.

The ascent/descent control function of the dive computer 4 of the second embodiment is implemented by way of an ascent velocity measuring unit 22, an ascent velocity violation determining unit 73, a diving results storage unit 74, a water thermometer 62, a notification unit 77, and a warning display unit 78, as shown in FIG. 27. The dive computer 4 of the second embodiment comprises an oxygen partial pressure calculating and monitoring unit 75, and an oxygen partial pressure violation determining unit 76. The ascent velocity measuring unit 22 measures the ascent velocity when an ascent is made on the basis of the measurement results from the timer 68 and the measurement results from the pressure gauge 61. The ascent velocity violation determining unit 73 compares the measurement results of the ascent velocity measuring unit 22 and the preset reference ascent velocity data 72, and provides an ascent velocity violation warning when the current ascent velocity is higher than the reference ascent velocity that corresponds to the reference accent velocity data 72. The diving results storage unit 74 stores diving history and other data related to diving. The oxygen partial pressure calculating and monitoring unit 75 calculates and monitors the oxygen partial pressure in the breathing gas. The oxygen partial pressure violation determining unit 76 determines whether the calculated oxygen partial pressure will result in oxygen poisoning or oxygen deficiency. The notification unit 77 provides warnings by way of the display unit, the sound alarm 37, and the oscillation generator 38. The warning display unit 78 displays warnings by way of the display unit 10.

More specifically, in the present embodiment, the ascent velocity violation determining unit 73 compares the current ascent velocity with the reference ascent velocity for each depth range stored in the ROM 53 as the reference ascent velocity data 72, and when the current ascent velocity is higher than the reference ascent velocity at the current depth, the notification unit 77 generates an alarm sound, causes the display unit 10 to blink, or produces another action by way of the display unit 10 or the sound alarm 37, transmits a vibration to the diver by way of the oscillation generator 38, or warns of an ascent velocity violation by another method. When the ascent velocity becomes equal to or less than the reference ascent velocity, the ascent velocity violation warning is stopped.

In the second embodiment, the following values are preferably set in the ROM 53 as the reference ascent velocity data 72 and examples of the depth ranges thereof.

| Depth range | Ascent velocity standard value |
|---|---|
| Less than 1.8 m | No warning |
| 1.8 m to 5.9 m | 8 m/minute (about 0.8 m/6 sec) |
| 6.0 m to 17.9 m | 12 m/minute (about 1.2 m/6 sec) |
| 18 m or more | 16 m/minute (about 1.6 m/6 sec) |

The reasons for setting the ascent velocity standard value to be larger at deeper depths in this manner are noted below. At deep depths, it is possible to adequately prevent decompression sickness even if a relatively high ascent velocity is allowed because the surrounding water pressure ratio before and after ascending is low per unit of time at the same ascent velocity. At shallow depths, only a relatively low ascent velocity is allowed because the water pressure ratio before and after ascending is higher per unit of time at the same ascent velocity.

In the present embodiment, the ascent velocity value for every six seconds is stored in the ROM 53 as the reference ascent velocity data in order to prevent the motion of the arm on which the dive computer is worn from affecting the calculated ascent speed, even if the depth is measured every second. For the same reason, the ascent velocity is also measured every six seconds.

As a result, the dive computer 4 calculates the difference between the current depth measurement value and the previous depth measurement value of six seconds ago, and this difference is compared with the reference ascent velocity the corresponds to the reference ascent velocity data 72, while preventing the motion of the arm on which the dive computer 4 is worn from affecting the calculated ascent speed.

The diving results storage unit 74 of the dive computer 4 stores the diving results data on the basis of the depth value that corresponds to the water pressure measured by the pressure gauge 61. In other words, a diving action that begins at a diving depth that is deeper than 1.5 m (depth value for determining the start of diving) and ends when the diving depth is once again shallower than 1.5 m is stored and held in the RAM 54 as the diving results data in this interval. Here, the diving result data includes the diving date and time data, diving control number data, dive time data, maximum diving depth data, and water temperature data at the maximum diving depth, for example.

This diving results storage unit 74 performs the functions of the CPU 51, ROM 53, and RAM 54 that comprise the control unit 50 shown in FIG. 5. Here, the diving results violation occurred when a plurality of consecutive warnings was issued by the ascent velocity violation determining unit 73 during a single dive; for example, that two or more consecutive warnings were issued.

This diving results storage unit 74 measures the dive time on the basis of the measurement results of the timer 68 in the interval of time beginning when the depth value corresponding to the water pressure measured by the pressure gauge 61 is deeper than 1.5 m (depth value for determining the start of diving), and ending when the depth is once again shallower than 1.5 m. If the measured dive time is less than three minutes, then this interval of time is not handled as a single dive, an the diving results during that interval of time are not stored. This is because, from the aspect of storage capacity, there is a possibility that important diving records will be updated if an attempt is made to store all the diving data, including brief dives such skin dives.

When the dive time is 3 minutes or greater at a depth of 1.5 m, the dive computer 4 in such an embodiment determines that a new dive has started, so when the depth is less than 1.5 m after diving begins, the depth is treated as if it were 0 m. Therefore, when the depth is slightly greater than 1.5 m, there is a possibility that an ascent velocity violation warning will be issued when the depth of the dive computer alone becomes less than 1.5 m as a result of the arm being raised, despite the fact that the ascent speed is being maintained, but the second embodiment is configured so that an ascent velocity violation warning is not issued in such a case, and the reliability of the ascent velocity violation warning is improved.

In the second embodiment, the oxygen partial pressure PO2 showing the danger level for oxygen poisoning or oxygen deficiency during a dive is calculated in the oxygen partial pressure calculating and monitoring unit 75, a determination is made by the oxygen partial pressure violation determining unit 76 as to whether the oxygen partial pressure PO2 is in a suitable range, and notifications are provided by warning display, alarm sounds, or the like by way of the notification unit 77 as needed. The value of the calculated oxygen partial pressure PO2 is displayed on the liquid crystal display panel 11 comprising the display unit 10.

The structure of the functions performed in the dive computer 4 for calculating the amount of inert gas accumulated in the body of the diver is subsequently described with reference to the block diagram in FIG. 28. FIG. 28 is a functional block diagram for implementing the function of calculating the amount of inert gas in the body by the dive computer 4. In this case, examples of inert gases accumulated in the body in the second embodiment include nitrogen and helium, and the amount of nitrogen (nitrogen partial pressure) and the amount of helium (helium partial pressure) are calculated.

Figure 28:
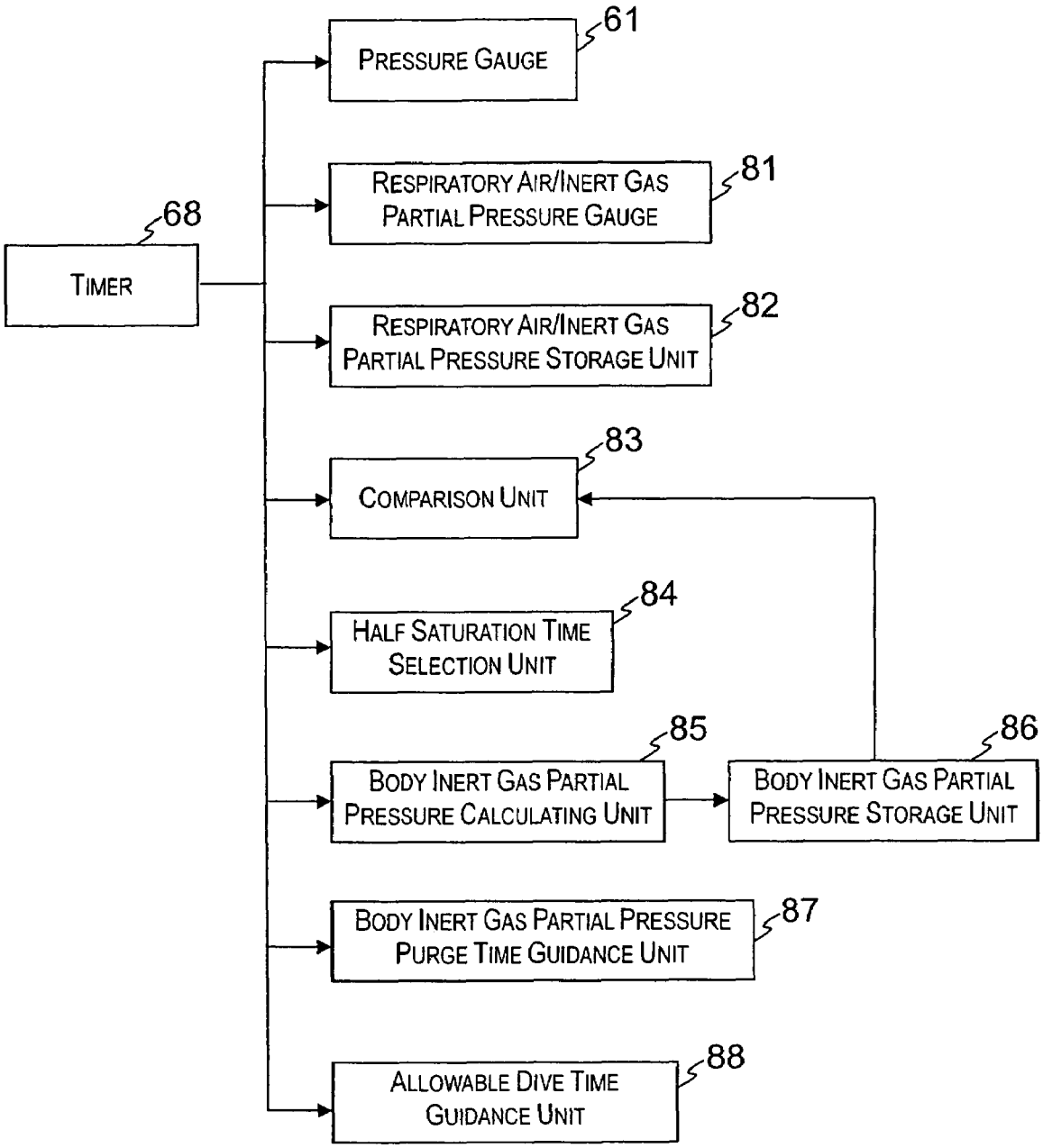
FIG. 28 is a functional block diagram for implementing the function of calculating the amount of inert gas in the body by the dive computer in the second embodiment of the invention.

The dive computer 4, in addition to the above-described timer 68 and pressure gauge 68, comprises a respiratory air/inert gas partial pressure gauge 81, a respiratory air/inert gas partial pressure storage unit 82, a comparison unit 83, a half saturation time selection unit 84, a body inert gas partial pressure calculating unit 85, a body inert gas partial pressure storage unit 86, a body inert gas partial pressure purge time guidance unit 87, and an allowable dive time guidance unit 88, as shown in FIG. 28. These may be implemented as software executed by the CPU 51, ROM 53, RAM 54, and the constituent components shown in FIG. 2. However, this option is non-limiting, and the above components may be implemented as logic circuits alone, which are hardware, or as a combination of software and processing circuits that comprise logic circuits and an MPU.

The respiratory air/inert gas partial pressure gauge 81 calculates the respiratory air/inert gas partial pressure PIN2(t), which is described hereinafter, on the basis of the water pressure P(t) at the current time t, which is the measurement result from the water pressure and depth gauge 61. The respiratory air/inert gas partial pressure storage unit 82 thereby stores the respiratory air/inert gas partial pressure PIN2(t) that was calculated by the respiratory air/inert gas partial pressure gauge 81.

The half saturation time selection unit 84 outputs the half saturation time TH that is used for calculating the body inert gas partial pressure to the body inert gas partial pressure calculating unit 85. The body inert gas partial pressure calculating unit 85 calculates the body inert gas partial pressure PGT(t), which is described hereinafter, for each tissue location in which the breathing/purging rate of inert gas differs. The body inert gas partial pressure storage unit 86 stores the body inert gas partial pressure PGT(t) that is calculated by the body inert gas partial pressure calculating unit 85. As a result, the comparison unit 83 compares the respiratory air/inert gas partial pressure PIN2(t) and the body inert gas partial pressure PGT(t), and varies the half saturation time TH on the basis of the comparison results.

Next, a specific method for calculating the body inert bas partial pressure will be described. The method for calculating the body inert gas partial pressure carried out in the dive computer 4 of the present embodiment is cited in "Dive Computers: A Consumer's Guide to History, Theory, and Performance" written by Ken Loyst, et al. (Watersport Publishing Inc., (1991)), and "Decompression-Decompression Sickness" written by A. A. Buhlmann (Springer, Berlin (1984)) (page 14 in particular), for example. The method of calculating the body inert gas partial pressure shown here is no more than an example, and other methods may also be used.

The water pressure and depth gauge 61 outputs the water pressure P(t) that corresponds to the time t. Here, P(t) refers to the absolute pressure including atmospheric pressure. The respiratory air/inert gas partial pressure gauge 81 calculates and outputs the respiratory air/inert gas partial pressure PIN2(t) in the air being breathed by the diver, on the basis of the water pressure P(t) outputted from the water and depth gauge 61. Here, the respiratory air/inert gas partial pressure PIN2(t) is calculated with the aid of the following expression (1) using the water pressure P(t).

$$PIN2(t)=(\text{inert gas mixture ratio})\times P(t)(\text{bar}) \quad (1)$$

The respiratory air/inert gas partial pressure storage unit 82 stores the value of the respiratory air/inert gas partial pressure PIN2(t) that is calculated with the aid of the expression (1) by the respiratory air/inert gas partial pressure gauge 81.

The body inert gas partial pressure calculating unit 85 calculates the body inert gas partial pressure for each tissue location in the body in which the breathing/purging of inert gas differs. As an example of a certain tissue, the body inert gas partial pressure PGT(tE) that is breathed/purged until the dive time t=t0 to tE is calculated with the aid of the following expression (2) as the body inert gas partial pressure PGT(t0) at the time of calculation (=t0).

$$PGT(tE)=PGT(t0)+\{PIN2(t0)-PGT(t0)\}\times\{1\ (\exp(-K(te-t0)/HT)\} \quad (2)$$

Here, K is a constant obtained through experimentation, and HT is the time (hereinafter referred to as half saturation time) required for the inert gas to dissolve in the tissue and achieve a state of half saturation, and the numerical values are different for each tissue. This half saturation time HT, as will be described below, varies in accordance with the size of the PGT(t0) and PIN2(t0). Measurement of the time t0, the time tE, and other times is controlled by the timer 68 shown in FIG. 28.

The body inert gas partial pressure calculating unit 85 repeatedly calculates the body inert gas partial pressure PGT (t) as described above at a predetermined sampling cycle tE. The body inert gas partial pressure PGT(tE) calculated with the aid of the expression every sampling cycle, in addition to being supplied to the body inert gas partial pressure purge time guidance unit 87 and the allowable dive time guidance unit 88, is also supplied as PGT(t0) to the comparison unit 83 and the body inert gas partial pressure purge time guidance unit 87 at this time. This means that the PGT(tE) at the previous time of sampling was used as the PGT(t0) in the expression.

Before the above-described calculation takes place, the comparison unit 83 compares PGT(t0) supplied from the body inert gas partial pressure storage unit 86 with the respiratory air/inert gas partial pressure PIN2(t0) stored in the respiratory air/inert gas partial pressure storage unit 82, and the result of the comparison thereof is output to the half saturation time selection unit 84. The half saturation time selection unit 84 stores the two types (a half saturation time HT1 and HT2 described hereinafter) of half saturation time HT that should be used by the body inert gas partial pressure calculating unit 85 in the calculation of partial pressure, and the half saturation time HT1 or HT2 is selected in accordance with the comparison result obtained by the comparison unit 83, and is output to the body inert gas partial pressure calculating unit 85.

The body inert gas partial pressure calculating unit 85 calculates the body inert gas partial pressure PGT(tE) with the aid of the following expression (3) or (3') using the half saturation time HT1 or HT2 selected by the half saturation time selection unit 84.

(A) In the case that PGT(t0)>PIN2(t0), $$PGT(tE)=PGT(t0)+\{PIN2(t0)-PGT(t0)\}\times\{1-\exp(-K(tE-t0)/HT1)\} \quad (3)$$

(B) In the case that PGT(t0)<PIN2(t0), $$PGT(tE)=PGT(t0)+\{PIN2(t0)-PGT(t0)\}\times\{1-\exp(-K(tE-t0)/HT2)\} \quad (3')$$

In the above-described expressions (3) and (3'), HT2<HT1. In the case that PGT(t0) (PIN2(t0), the half saturation time HT is preferably set as in the following expression (4).

$$HT=(HT1+HT2)/2 \quad (4)$$

The reasons that the half saturation time HT is different when PGT(t0) (PIN2(t0) and when PGT(t0) (PIN2(t0) are described below. First, when PGT(t0) (PIN2(t0), inert gas is being purged from the body, and when PGT(t0) (PIN2(t0), inert gas is being absorbed by the body. That is to say, the half saturation time HT1 when purging inert gas is set longer than the half saturation time HT2 when absorbing inert gas because the purging of inert gas requires more time in comparison with the absorption of inert gas. By using a half saturation time HT that differs during purging and during absorption in this manner, the simulation of the amount of inert gas in the body can be carried out with exactness. Therefore, on the basis of the inert gas partial pressure that is computed by this virtual body inert gas calculating unit, it is possible to calculate a more accurate value when computing the allowable non-decompression time and the time required to purge inert gas from the body. The body inert gas partial pressure calculating unit 85 allows the most recent body inert gas partial pressure to be obtained for the currently submerged diver by calculating the body inert gas partial pressure PGT(t) as described above.

The allowable non-decompression time and the time required to purge inert gas from the body are calculated as follows on the basis of the body inert gas partial pressure PGT(tE) that was computed as described above, and on the basis of the respiratory air/inert gas partial pressure PIN2(tE) that was calculated by the respiratory air/inert gas partial pressure gauge 81. The allowable non-decompression time is calculated by computing (tE−t0) when the PGT(tE) calculated in the expression becomes Ptol, which indicates the amount of allowable supersaturating inert gas for each tissue. Here, because the current point in time is considered to be t0, the body inert gas partial pressure PGT(tE) that was computed by the body inert gas partial pressure calculating unit 85 is used as the PGT(t0) in the expression; and the respiratory air/inert gas partial pressure PIN2(tE) that was calculated by the respiratory air/inert gas partial pressure gauge 81 is used as the PIN2(t0).

In other words, $$tE-t0=-HT\times(1n(1-f))/K \quad (5)$$

In the formula, $$f=(Ptol-PGT(tE))/(PIN2(tE)-PGT(tE)).$$

The allowable non-decompression time is calculated for each type of tissue with the aid of this expression (5), and the lowest value among these is the computed allowable non-decompression time. The calculated allowable non-decompression time is displayed in the diving mode, as described hereinafter.

Next, the method for calculating the time required to purge inert gas from the body after ascending to the surface will be described.

To calculate the time required to purge inert gas from the body, tE should be computed so that PGT(tE)=0, with t0 serving as the time of ascent to the surface in the above-described (2).

$$PGT(tE)=PGT(t0)+\{PIN2(t0)-PGT(t0)\}\times\{1-\exp(-K(tE-t0)/HT)\} \quad (2)$$

However, with an exponential function such as the above-described expression (2), PGT(tE) will not equal 0 if tE does not become infinite, so, for the sake of convenience, the body inert gas purge time tZ is calculated for each tissue using the expression (6) below.

$$tZ=-HT\times 1n(1-f)/K \quad (6)$$

In the formula, $$f=(Pde-PIN2)/(0.79-PIN2).$$

Here, HT is the above-described half saturation time, and Pde is the inert gas partial pressure (hereinafter referred to as the allowed inert gas partial pressure) to be used in the purging of the residual inert gas from each tissue type, and both of these are known values. PIN2 is the inert gas partial pressure within each tissue at the time of ascent to the surface, and it is calculated by the body inert gas partial pressure calculating unit 85. For each tissue type, tZ is calculated with the aid of the above-described expression, and the largest value among them is the time required to purge inert gas from the body. The time required to purge inert gas from the body that is calculated in this manner is displayed in a surface mode, which is described below.

The operation of the dive computer 4 of the second embodiment as described above is similar to the first embodiment, so a description is provided with reference to FIG. 13.

The dive computer 4 has the following operating modes: a time mode ST1, a surface mode ST2, a planning mode ST3, a setting mode ST4, a diving mode ST5, a log mode ST6, and a cylinder switching condition setting mode ST7, as shown in FIG. 13. The diving mode ST5 related to the second embodiment will now be described.

In the same manner as the diving mode ST5 of the first embodiment, the diving mode ST5 of the second embodiment is an operation mode used during diving, and it comprises a non-decompression diving mode ST51, a current time display mode ST52, a decompression diving mode ST53, and a cylinder switch control mode ST54.

The current depth, the dive time, the maximum depth, the time during which diving without decompression is possible, the graph of the inert gas in the body, the elevation rank, and other information required in diving are displayed in the non-decompression diving mode ST51.

In the diving mode ST5 of the second embodiment, the ascent velocity monitoring function described above is used because a rapid ascent results in decompression sickness. That is to say, the current ascent velocity is calculated every predetermined interval of time (every six seconds, for example); the calculated ascent velocity and the ascent velocity upper limit value corresponding to the current depth are compared; and in the case that the calculated ascent velocity is higher than the ascent velocity upper limit value, an alarm sound (ascent velocity violation warning alarm) is issued for three seconds at a frequency of 4 kHz from the sound alarm 37, and the ascent velocity violation warning is performed by alternately displaying the current depth and the warning "SLOW" on the liquid crystal display panel 11 with a predetermined cycle (a one second cycle, for example) to suggest that the ascent velocity be slowed. The diver is further warned of the ascent velocity violation by a vibration from the oscillation generator 38. The ascent velocity violation warnings stop once the ascent velocity decreases to a normal level.

In the diving mode ST5, when the diver has ascended to a depth that is shallower than 1.5 m, diving is deemed completed, and the system automatically shifts to the surface mode ST2 when the diving operation monitoring switch 30, which was in a conductive state during diving, enters a non-conductive state. The interval from the time at which the depth is 1.5 m or more to the time at which the depth is again less 1.5 m is defined as a single diving action, and the diving results (the diving date, dive time, maximum depth, and other data) during this interval of time are stored in the RAM 54. In the case that two or more consecutive ascent velocity violation warnings described above are issued during a dive, this is also recorded in the diving results.

According to the second embodiment as described above, switching to a cylinder whereby there is danger of oxygen poisoning or oxygen deficiency can be prevented or notification (warning) can be provided, diving can be performed safely, and the occurrence of diving sickness can be prevented in advance by issuing an ascent velocity violation warning when the current ascent velocity is higher than the reference ascent velocity, even the dive is made using a plurality of cylinders that contain a plurality of mixed gases with differing mixture ratios of a plurality of diving gases.

Additionally, a configuration in which the diver switched the cylinders was adopted in the description above, but it is also possible to configure the system to wait for instructions from the diver and then automatically carry out the switch. Naturally in this case, it is preferable to provide a configuration that allows manual switching in case of emergency. The dive computer 4 must also be configured so as to generate an alarm sound with a sound alarm, generate an alarm vibration with an oscillation generator, or display a warning on a liquid crystal display panel, and to prohibit automatic cylinder switching when there is danger of oxygen poisoning, and when there is a possibility oxygen deficiency. The system can also be configured so that notification of danger of oxygen poisoning or oxygen deficiency is provided to the diver even if the diver gives switching instructions earlier, and the switch can be temporarily stopped and then executed only when instructions are given again.

The above description was provided with the assumption that the program for carrying out each of the operations described above is stored in the ROM 53 in advance. However, this option is non-limiting, and a mode may be adopted whereby the dive computer is connected to a personal computer or server computer (not depicted) by way of a communication cable or a network, and the above-described program is downloaded to the dive computer from the personal computer or server computer. In this case, the program is stored in rewritable nonvolatile memory (not depicted) inside the dive computer. The CPU 51 then simply reads and executes this program from the nonvolatile memory.

According to the second embodiment as described above, the mixture ratio of the diving gases in the plurality of cylinders is set in accordance with a diving pattern, and a simulation of the timing at which each cylinder is used is performed before diving. The switch timing is set in the dive computer on the basis of the results of this simulation, and the dive computer can take the actual diving pattern into consideration during an actual dive and improve the safety of diving by providing the diver with a notification of the timing at which a cylinder is to be used.

The time during which decompression diving is possible with respect to the mixture ratio of the diving gases, and the depth and time required for a decompression stop during decompression diving can be simulated in advance, so a determination as to whether it is safe to switch the cylinders can be unerringly made even during actual diving.

In the description above, oxygen, nitrogen, and helium were used as the diving gases that constituted the mixed gas, but it is also possible to use combinations of oxygen, nitrogen, and hydrogen as the mixed gas; to use neon (Ne), argon (Ar), krypton (Kr), xenon (Xe), or other gases in which the likelihood of negatively affecting the human body is low, as inert gases that may serve as the diving gas; and other mixed gases or known diving gases selected in accordance with the diving conditions.

Also in the description above, the case in which three types of diving gas are used was described, but it is also possible to configure the diving gas to include four or more types of gas.

The term "configured" as used herein to describe a component, section or part of a device includes hardware and/or software that is constructed and/or programmed to carry out the desired function.

As used herein, the following directional terms "forward, rearward, above, downward, vertical, horizontal, below and transverse" as well as any other similar directional terms refer to those directions of an information processing device for diver or a diving equipment of the present invention. Accordingly, these terms, as utilized to describe the present invention should be interpreted relative to an information processing device for diver or a diving equipment of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This specification claims priority to Japanese Application Numbers 2002-359191, 2002-359192, 2002-368170, 2003-367213, 2003-367214, and 2003-367215. All of the disclosures of Japanese Application Numbers 2002-359191, 2002-359192, 2002-368170, 2003-367213, 2003-367214, and 2003-367215 are hereby incorporated by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. An information processing device for a diver adapted to be used for diving with at least first and second cylinders respectively containing first and second mixed gases in which a plurality of diving gases are mixed with different mixture ratios for each of said first and second cylinders, comprising:

an oxygen partial pressure calculating and monitoring unit configured to calculate oxygen partial pressure of each of said first and second cylinders, said oxygen partial pressure calculating and monitoring unit making automatic switching from said first cylinder to said second cylinder impossible based on a result of calculating said oxygen partial pressure, upon a determination of a possibility of oxygen deficiency or oxygen poisoning in using said second cylinder.

2. The information processing device according to claim 1, wherein at least one of said first and second cylinders contains oxygen as one of the diving gases.

3. The information processing device according to claim 1, wherein said oxygen partial pressure calculating and monitoring unit includes an oxygen partial pressure violation determining unit configured to calculate an oxygen partial pressure and determine whether there is the possibility of oxygen poisoning or oxygen deficiency, and a notification unit configured to notify the diver when there is the possibility of oxygen poisoning or oxygen deficiency.

4. The information processing device according to claim 3, wherein said notification unit is configured to notify the diver whether switching to said second cylinder is permitted by using at least one of display, alarm sound, and alarm vibration.

5. The information processing device according to claim 1, wherein said oxygen partial pressure calculating and monitoring unit is configured to execute a process that permit switching from said first cylinder to said second cylinder, when the diver selects to use said second cylinder while using said first tank, and upon a determination of no possibility of oxygen deficiency or oxygen poisoning based on an oxygen partial pressure value if said second cylinder is used.

6. The information processing device according to claim 1, further comprising, a time keeping section configured to measure an elapsed dive time;

a water depth gauging section configured to detect a water depth value at a diving location of the diver in accordance with a preset elapsed dive time; and a diving information storage unit configured to store said elapsed dive time and said detected water depth value.

7. A control method for an information processing device for a diver adapted to be used for diving with at least first and second cylinders respectively containing first and second mixed gases in which a plurality of diving gases are mixed with different mixture ratios for each of said first and second cylinders, comprising:

performing an oxygen partial pressure calculating and monitoring step for calculating and monitoring oxygen partial pressure; and performing a switch prohibiting step for calculating oxygen partial pressure of each of said first and second cylinders and making automatic switching from said first cylinder to the said second cylinder impossible based on a result of calculating said oxygen partial pressure, upon a determination of a possibility of oxygen deficiency or oxygen poisoning in using said second cylinder.

8. The control method for the information processing device according to claim 7, further comprising said oxygen partial pressure calculating and monitoring step includes performing an oxygen partial pressure violation determining step for determining whether there is the possibility of oxygen poisoning or oxygen deficiency, and performing a notification step for notifying the diver when there is the possibility of oxygen poisoning or oxygen deficiency.

9. The control method for the information processing device according to claim 8, wherein said notification step includes notifying the diver whether switching to said second cylinder is permitted by using at least one of display, alarm sound, and alarm vibration.

10. The control method for the information processing device according to claim 7, wherein the switch prohibiting step includes permitting switching from said first cylinder to said second cylinder, when the diver selects to use said second cylinder while using said first tank, and upon a determination of no possibility of oxygen deficiency or oxygen poisoning based on an oxygen partial pressure value if said second cylinder is used.

11. The control method for the information processing device according to claim 7, further comprising performing a time keeping step for measuring an elapsed dive time, performing a water depth gauging step for detecting a water depth value at a diving location of the diver in accordance with a preset elapsed dive time, and performing a diving information storing step for storing said elapsed dive time and said detected water depth value.

12. A control program for controlling with a computer an information processing device for a diver adapted to be used for diving with at least first and second cylinders respectively containing first and second mixed gases in which a plurality of diving gases are mixed with different mixture ratios for each of said first and second cylinders, comprising instructions for performing:

calculating and monitoring oxygen partial pressure of each of said first and second cylinder;

determining a possibility of oxygen deficiency or oxygen poisoning if said second cylinder is used when the diver selects to switch to said second cylinder while using said first cylinder; and making automatic switching from said first cylinder to said second cylinder impossible based on a result of calculating said oxygen partial pressure, upon a determination of a possibility of oxygen deficiency or oxygen poisoning un using said second cylinder.

13. The control program according to claim 12, further comprising instructions for performing determining whether there is the possibility of oxygen poisoning or oxygen deficiency based on the oxygen partial pressure; and notifying the diver when there is the possibility of oxygen poisoning or oxygen deficiency.

14. The control program according to claims 12 or 13, wherein said oxygen partial pressure calculating and monitoring unit permits switching from said first cylinder to said second cylinder, when the diver selects to use said second cylinder while using said first tank, and upon a determination of no possibility of oxygen deficiency or oxygen poisoning based on an oxygen partial pressure value if said second cylinder is used.

15. The control program according to claim 14, further comprising a instruction for performing notifying the diver whether switching to said second cylinder is permitted by using at least one of display, alarm sound, or and alarm vibration.

16. The control program according to claim 12, further comprising instructions for performing measuring an elapsed dive time, detecting a water depth value at a diving location of the diver in accordance with a preset elapsed dive time, and storing said elapsed dive time and said detected depth value.

17. A computer readable recording medium for storing a control program for controlling with a computer an information processing device for a diver adapted to be used for diving with at least first and second cylinders respectively containing first and second mixed gases in which a plurality of diving gases are mixed with different mixture ratios for each of said first and second cylinders, comprising instructions for performing:

calculating and monitoring oxygen partial pressure;

determining a possibility of oxygen deficiency or oxygen poisoning if said second cylinder is used when the diver selects to switch to said second cylinder while using said first cylinder; and making automatic switching from said first cylinder to said second cylinder impossible, upon a determination of the possibility of oxygen deficiency or oxygen poisoning.

* * * * *